US008048200B2

(12) United States Patent
Gefter et al.

(10) Patent No.: US 8,048,200 B2
(45) Date of Patent: Nov. 1, 2011

(54) CLEAN CORONA GAS IONIZATION FOR STATIC CHARGE NEUTRALIZATION

(76) Inventors: Peter Gefter, South San Francisco, CA (US); Aleksey Klochkov, San Francisco, CA (US); John E. Menear, Santa Cruz, CA (US); Lyle Dwight Nelsen, San Jose, CA (US)

( * ) Notice: Subject to any disclaimer, the term of this patent is extended or adjusted under 35 U.S.C. 154(b) by 0 days.

(21) Appl. No.: 12/799,369

(22) Filed: Apr. 23, 2010

(65) Prior Publication Data

US 2010/0269692 A1 Oct. 28, 2010

Related U.S. Application Data

(60) Provisional application No. 61/214,519, filed on Apr. 24, 2009, provisional application No. 61/276,792, filed on Sep. 16, 2009, provisional application No. 61/279,784, filed on Oct. 26, 2009, provisional application No. 61/337,701, filed on Feb. 11, 2010.

(51) Int. Cl.
*B03C 3/36* (2006.01)

(52) U.S. Cl. ..... 95/58; 95/78; 96/52; 96/63; 96/97; 361/213; 361/233

(58) Field of Classification Search ..... 95/58, 78; 96/52, 60, 62, 63, 96, 97; 361/213, 225–235
See application file for complete search history.

(56) References Cited

U.S. PATENT DOCUMENTS

| | | | | |
|---|---|---|---|---|
| 3,374,941 A | | 3/1968 | Okress | 315/111.91 |
| 3,585,060 A | * | 6/1971 | Gourdine et al. | 427/460 |
| 3,764,804 A | | 10/1973 | Hirschman | 250/49.5 |
| 3,768,258 A | * | 10/1973 | Smith et al. | 60/275 |
| 4,258,736 A | | 3/1981 | Denbow | 137/2 |
| 4,734,105 A | * | 3/1988 | Eliasson et al. | 95/62 |
| 4,812,711 A | * | 3/1989 | Torok et al. | 315/111.91 |
| 4,976,752 A | * | 12/1990 | Torok et al. | 96/43 |
| 5,116,583 A | | 5/1992 | Batchelder et al. | 422/186.07 |
| 5,296,018 A | * | 3/1994 | Suzuki | 95/65 |
| 5,447,763 A | | 9/1995 | Gehlke | 428/34.1 |
| 5,550,703 A | | 8/1996 | Beyer et al. | 361/229 |
| 5,650,203 A | | 7/1997 | Gehlke | 428/34.1 |
| 5,847,917 A | | 12/1998 | Suzuki | 361/213 |
| 6,373,680 B1 | | 4/2002 | Riskin | 361/231 |
| 6,563,110 B1 | | 5/2003 | Leri | 250/282 |

(Continued)

FOREIGN PATENT DOCUMENTS

JP 2004273293 9/2004

(Continued)

OTHER PUBLICATIONS

PCT Application PCT/US01/01215, Notification of Transmittal of the International Search Report . . . and associated International Search Report, mailed Jul. 9, 2010; 3 pages total.

(Continued)

*Primary Examiner* — Richard L Chiesa
(74) *Attorney, Agent, or Firm* — The Patent Source

(57) ABSTRACT

Clean corona gas ionization by separating contaminant byproducts from corona generated ions includes establishing a non-ionized gas stream having a pressure and flowing in a downstream direction, establishing a plasma region of ions and contaminant byproducts in which the pressure is sufficiently lower than the pressure of the non-ionized gas stream to prevent at least a substantial portion of the byproducts from migrating into the non-ionized gas stream, and applying an electric field to the plasma region sufficient to induce at least a substantial portion of the ions to migrate into the non-ionized gas stream.

42 Claims, 15 Drawing Sheets

U.S. PATENT DOCUMENTS

| | | | | |
|---|---|---|---|---|
| 6,566,887 | B2 | 5/2003 | Smith et al. | 324/514 |
| 6,636,411 | B1 | 10/2003 | Noll | 361/213 |
| 6,646,856 | B2 | 11/2003 | Lee et al. | 361/232 |
| 6,693,788 | B1 | 2/2004 | Partridge | 361/231 |
| 6,807,044 | B1 | 10/2004 | Vernitsky et al. | 361/230 |
| 6,850,403 | B1 | 2/2005 | Gefter et al. | 361/230 |
| 7,051,419 | B2 | 5/2006 | Schrom et al. | 29/854 |
| 7,120,007 | B2 | 10/2006 | Nakasone et al. | 361/231 |
| 7,208,030 | B2 * | 4/2007 | Totoki | 96/19 |
| 7,356,987 | B2 * | 4/2008 | Kiser et al. | 60/278 |
| 7,365,316 | B2 | 4/2008 | Miller et al. | 250/288 |
| 7,375,944 | B2 | 5/2008 | Izaki et al. | 361/230 |
| 7,697,258 | B2 | 4/2010 | Vernitskiy et al. | 361/230 |
| 7,813,102 | B2 | 10/2010 | Gefter et al. | 361/213 |
| 2004/0045442 | A1 * | 3/2004 | Ramizovich et al. | 96/94 |
| 2006/0187609 | A1 | 8/2006 | Dunn | 361/230 |
| 2006/0193100 | A1 | 8/2006 | Izaki et al. | 361/220 |
| 2006/0260928 | A1 | 11/2006 | Avnery et al. | 204/157.3 |
| 2006/0285269 | A1 | 12/2006 | Ohtsuka et al. | 361/225 |
| 2007/0006478 | A1 | 1/2007 | Kotsuji | 34/96 |
| 2007/0025771 | A1 | 2/2007 | Robles Flores et al. | 399/172 |
| 2007/0158578 | A1 | 7/2007 | Vernitskiy et al. | 250/423 R |
| 2007/0181820 | A1 | 8/2007 | Hwang et al. | 250/396 R |
| 2008/0078291 | A1 * | 4/2008 | Daukant | 95/69 |
| 2008/0130190 | A1 | 6/2008 | Shimada | 361/231 |
| 2008/0225460 | A1 | 9/2008 | Gefter et al. | 361/213 |
| 2008/0232021 | A1 | 9/2008 | Gefter et al. | 361/213 |
| 2009/0050801 | A1 | 2/2009 | Fedorov | 250/288 |
| 2010/0044581 | A1 | 2/2010 | Fujita et al. | 250/424 |
| 2010/0128408 | A1 | 5/2010 | Takayanagi | 361/213 |

FOREIGN PATENT DOCUMENTS

| | | | |
|---|---|---|---|
| JP | 2004362951 | 12/2004 | |
| JP | 2006236763 | 9/2006 | 3/4 |
| JP | 2007048682 | 2/2007 | 3/4 |

OTHER PUBLICATIONS

PCT Application PCT/US01/01215, Written Opinion of the International Searching Authority, mailed Jul. 9, 2010; 7 pages total.

Freescale Semiconductor, Inc. datasheet (Rev 0) for MPXV6115 Series including data for MPXV6115VC6U Integrated Pressure Sensor, 8 pages on 8 sheets, 2009.

Atmel Corporation datasheet for 8-bit AVR with 8K Bytes In-System Programmable Flash including data for ATMEGA8 microcontroller, 22 pages on 11 sheets, 2003.

Fox Valve Development Corp. Bulletin 401 A including data for Fox Mini-Eductors, 10 pages on 10 sheets, Nov. 21, 2002.

Anver Corporation catalog, Section 3 (Air Powered Vacuum Generators & Accessories) including datas for ANVER JV-09 Series Mini Vacuum Generator, 88 pages on 44 sheets, date unknown.

United Filtration System Inc., disposable in-line filter datasheets including the DIF-MN50 filter, 6 pages on 6 sheets, Jan. 31, 2006.

Automated *JPO/INPIT* translation of Abstract, Description, and Claims of JP 2007-048682 A, 8 pages.

Automated *JPO/INPIT* translation of Abstract, Description, and Claims of JP 2006-236763 A, 9 pages.

Automated JPO/INPIT translation of JP 2004-273293 A 28 pages.

Automated JPO/INPIT translation of JP 2004-362951 A 29 pages.

PCT Application PCT/US2010/053741, Notification of Transmittal of the International Search Report . . . and associated International Search Report, mailed Dec. 22, 2010; 4 pages total.

PCT Application PCT/US2010/053741, Written Opinion of the International Searching Authority, Dec. 22, 2010; 9 pages total.

PCT Application PCT/US2010/053996, Notification of Transmittal of the International Search Report . . . and associated International Search Report, mailed Dec. 23, 2010; 4 pages total.

PCT Application PCT/US2010/053996, Written Opinion of the International Searching Authority, Dec. 23, 2010; 7 pages total.

PCT Application PCT/US2011/024010, Notification of Transmittal of the International Search Report . . . and associated International Search Report, mailed Apr. 6, 2011; 4 pages total.

PCT Application PCT/US2011/024010, Written Opinion of the International Searching Authority, mailed Apr. 6, 2011; 10 pages total.

* cited by examiner

CLEAN CORONA GAS IONIZATION FOR STATIC CHARGE NEUTRALIZATION

CROSS REFERENCE TO RELATED CASES

This application claims the benefit under 35 U.S.C. 119(e) of the following co-pending U.S. Applications: U.S. application Ser. No. 61/214,519 filed Apr. 24, 2009 and entitled "Separating Particles and Gas Ions in Corona Discharge Ionizers"; U.S. application Ser. No. 61/276,792 filed Sep. 16, 2009 entitled "Separating Particles and Gas Ions in Corona Discharge Ionizers"; U.S. application Ser. No. 61/279,784, filed Oct. 26, 2009 and entitled "Covering Wide Areas With Ionized Gas Streams"; U.S. application Ser. No. 61/337,701 filed Feb. 11, 2010 and entitled "Separating Contaminants From Gas Ions In Corona Discharge Ionizers"; which applications are all hereby incorporated by reference in their entirety.

BACKGROUND OF THE INVENTION

1. Field of the Invention

The invention relates to the field of static charge neutralization apparatus using corona discharge for gas ion generation. More specifically, the invention is directed to producing contaminant-free ionized gas flows for charge neutralization in clean and ultra clean environments such as those commonly encountered in the manufacture of semiconductors, electronics, pharmaceuticals and similar processes and applications.

2. Description of the Related Art

Processes and operations in clean environments are specifically inclined to create and accumulate electrostatic charges on all electrically isolated surfaces. These charges generate undesirable electrical fields, which attract atmospheric aerosols to the surfaces, produce electrical stress in dielectrics, induce currents in semi-conductive and conductive materials, and initiate electrical discharges and EMI in the production environment.

The most efficient way to mediate these electrostatic hazards is to supply ionized gas flows to the charged surfaces. Gas ionization of this type permits effective compensation or neutralization of undesirable charges and, consequently, diminishes contamination, electrical fields, and EMI effects associated with them. One conventional method of producing gas ionization is known as corona discharge. Corona-based ionizers, (see, for example, published patent applications US 20070006478, JP 2007048682) are desirable in that they may be energy and ionization efficient in a small space. However, one known drawback of such corona discharge apparatus is that the high voltage ionizing electrodes/emitters (in the form of sharp points or thin wires) used therein to generate undesirable contaminants along with the desired gas ions. Corona discharge may also stimulate the formation of tiny droplets of water vapor, for example, in the ambient air.

The formation of solid contaminant byproducts may also result from emitter surface erosion and/or chemical reactions associated with corona discharge in an ambient air/gas atmosphere. Surface erosion is the result of etching or spattering of emitter material during corona discharge. In particular, corona discharge creates oxidation reactions when electronegative gasses such as air are present in the corona. The result is corona byproducts in form of undesirable gases (such as ozone, and nitrogen oxides) and solid deposits at the tip of the emitters. For that reason conventional practice to diminish contaminant particle emission is to use emitters made from strongly corrosive-resistant materials. This approach, however, has its own drawback: it often requires the use of emitter material, such as tungsten, which is foreign to the technological process, such as semiconductor manufacturing. The preferred silicon emitters for ionizers used to neutralize charge during the manufacture of semiconductor wafers do not possess the desired corrosive resistance.

An alternative conventional method of reducing erosion and oxidation effects of emitters in corona ionizers is to continuously surround the emitter(s) with a gas flow stream/sheath of clean dry air (CDA), nitrogen, etc. flowing in the same direction as the main gas stream. This gas flow sheath is conventionally provided by high-pressure source of gas as shown and described in published Japanese application JP 2006236763 and in U.S. Pat. No. 5,847,917.

U.S. Pat. No. 5,447,763 Silicon Ion Emitter Electrodes and U.S. Pat. No. 5,650,203 Silicon Ion Emitter Electrodes disclose relevant emitters and the entire contents of these patents are hereby incorporated by reference. To avoid oxidation of semiconductor wafers manufacturers utilize atmosphere of electropositive gasses like argon and nitrogen. Corona ionization is accompanied by contaminant particle generation in both cases and, in the latter case, emitter erosion is exacerbated by electron emission and electron bombardment. These particles move with the same stream of sheath gas and are able to contaminate objects of charge neutralization. Thus, in this context the cure for one problem actually creates another.

Various ionizing devices and techniques are described in the following U.S. patents and published patent application, the entire contents of which are hereby incorporated by reference: U.S. Pat. No. 5,847,917, to Suzuki, bearing application Ser. No. 08/539,321, filed on Oct. 4, 1995, issued on Dec. 8, 1998 and entitled "Air Ionizing Apparatus And Method"; U.S. Pat. No. 6,563,110, to Leri, bearing application Ser. No. 09/563,776, filed on May 2, 2000, issued on May 13, 2003 and entitled "In-Line Gas Ionizer And Method"; and U.S. Publication No. US 2007/0006478, to Kotsuji, bearing application Ser. No. 10/570085, filed Aug. 24, 2004 and published Jan. 11, 2007, and entitled "Ionizer".

SUMMARY OF THE INVENTION

The present invention overcomes the aforementioned and other deficiencies of the related art by providing improved clean corona discharge methods and apparatus for separating corona-generated ions from contaminant byproducts and for delivering the clean ionized stream to a neutralization target.

The invention may achieve this result by superimposing ionizing and non-ionizing electrical fields to thereby produce ions and byproducts and to thereby induce the ions into a non-ionized gas stream as it flows toward a neutralization target. The non-ionizing electrical field should be strong enough to induce the ions to enter into the non-ionized gas stream to thereby form an ionized gas stream, but not strong enough to move substantially any contaminant byproducts into the non-ionized gas stream. Alone or in combination with the aforementioned non-ionizing electric field, the invention may also use gas pressure differential(s) to separate the ions from contaminants (such as one or more of (1) small particles, (2) liquid droplets and/or (3) certain undesirable gases).

The inventive method of separating is based on the different electrical and mechanical mobility of positive and/or negative ions (on the one hand) and contaminant byproducts (on the other). In general, it has been discovered that contaminant byproducts generated by the corona electrode(s)/emitter(s) have mechanical and electrical mobilities several orders of magnitude lower than positive and/or negative ions. For this reason, and in accordance with the invention, corona generated ions are able to move away from the corona electrode(s)/emitter(s) under the influence of electrical field(s) and/or gas flow but the less-mobile contaminants byproducts may be suspended and entrained in the vicinity of the emitter tip(s). Consequently, and in accordance with the invention, these contaminant byproducts may also be evacuated from the plasma region while the clean and newly ionized gas stream is delivered to a target for static charge neutralization.

More particularly, air and other gas ions are so small that they are a fraction of a nanometer in diameter and their mass is measured in atomic mass units (amu). They usually carry a charge magnitude equal to one electron. For example, nitrogen molecules have mass of 28 amu, oxygen molecules have a mass of about 32 amu, and electrons have a mass of about 5.5 E-4 amu. Typical electrical mobility of a gas ion is in the range of about 1.5-2 [$cm^2/Vs$].

By contrast, corona discharge contaminant particles are significantly larger in diameter (in the range of tens to hundreds nanometers) and have significantly larger mass. Since mechanical mobility of particles is inversely related to their mass and/or diameter, the bigger and more massive the particles are, the smaller their mobility. For comparison, a 10 nm silicon particle has a mass of about 7.0 E4 amu. A 22 nm air borne particle has electrical mobility of about 0.0042 [$cm^2/Vs$].

It has further been discovered that only a small portion of nanometer contaminants particles of the type discussed herein are able to carry any charge. By contrast, gas ions typically have a charge of at least one elementary charge.

In accordance with the inventive corona discharge methods and apparatus disclosed herein, there are two distinct regions between the ion emitter(s) and a non-ionizing reference electrode (discussed in detail below):

(a) a plasma region which is a small (about (millimeter in diameter) and generally spherical region, generally centered at or near each ion emitter tip (s) where a high-strength electrical field provides electrons with sufficient energy to generate new electrons and photons to, thereby, sustain the corona discharge; and (b) a dark space which is an ion drift region between the glowing plasma region and a non-ionizing reference electrode.

In one form, the invention comprises a method separating ions and contaminant particles by presenting at least one non-ionized gas stream having a pressure and flowing in a downstream direction while maintaining a lower pressure in the plasma region at the ionizing electrode. For example, this embodiment may use a through-channel that surrounds the ion drift region, while a low-pressure emitter shell, at least partially disposed within the non-ionizing stream, substantially shields the ionizing electrode and its plasma region from the non-ionized gas stream of the ion drift region. The resulting pressure differential prevents at least a substantial portion of the contaminant byproducts from moving out of the plasma region and into the non-ionizing stream.

Additionally, some forms of the present invention envision gas flow ionizers for creating gas ions with concurrent removal of corona byproducts. The inventive ionizers may have at least one through-channel and a shell assembly. The assembly may include an emitter shell, some means for producing a plasma region comprising ions and contaminant byproducts to which an ionizing electrical potential may be applied. The means for producing ions (such as an emitter) and its associated plasma region may be at least partially disposed within the emitter shell and the shell may have an orifice to allow at least a substantial portion of the ions to migrate into the non-ionized gas stream (the main gas stream) flowing through the ion drift region and within the through-channel. At least a portion of the plasma region may be maintained at a pressure low enough to prevent substantially all of the corona byproducts from migrating into the main ion stream, but not low enough to prevent at least a substantial portion of the gas ions from migrating into the main ion stream. The gas flowing through the ion drift region of the through-channel may, thus, be converted into a clean ionized gas stream that delivers these ions in the downstream direction of the neutralization target. Simultaneously, the low pressure emitter shell may protect or shield the means for producing ions and its plasma region from the relatively high pressure of the non-ionized gas stream such that substantially no contaminant byproducts migrate into the main ion stream.

In some embodiments, the present invention may employ one or more optional evacuation port(s) in gas communication with the emitter shell through which contaminant byproducts may be evacuated.

In some other embodiments, the present invention may employ an optional contaminant byproduct trap/filter in gas communication with the evacuation port and a source of gas with a pressure lower than the ambient atmosphere.

Another optional feature of the present invention includes the use of a vacuum and/or a low-pressure sensor with an output that is communicatively linked to an ionizer control system. With such an arrangement the control system may be used to take various actions in response to a trigger signal. For example, the control system may shut down the high voltage power supply to thereby prevent gas flow in the through-channel from being contaminated by corona byproducts if the pressure level in the evacuation port increases above a predetermined threshold level.

In another optional aspect of present invention may include the use of an eductor having a motive section, an expansion chamber with a suction port, and an exhaust section. The suction port of the chamber may be in gas communication with the outlet of the contaminant filter. As a result, corona byproducts may be drawn toward the suction port of the eductor via the evacuation port of the emitter shell.

A related optional aspect of present invention envisions the use of a means for recirculating gas from the emitter shell to the expansion chamber of the eductor and for cleaning corona byproducts from all or some of the recirculated gas.

Another form of the invention may include at least one reference (non-ionizing) electrode positioned within or outside the through-channel to electrically induce the positive and/or negative ions to migrate out of the plasma region and into the main gas stream when a non-ionizing electrical potential is applied thereto. This form of the invention may achieve the goal(s) of the invention alone or may be used in conjunction with the pressure differential methods and/or apparatus discussed herein.

The through-channel may be made, at least in part, from a highly resistive material and the reference electrode may be positioned on the external surface of the through-channel. As a result, efficient ion harvesting and transfer by the high-pressure gas stream may be achieved at lower corona currents because particle generation and corona chemical reactions are reduced.

In another optional aspect of the invention, AC voltage may be applied to the at least one emitter to create a bipolar plasma region near the emitter tip and at least greatly reduce charge accumulation on corona-generated contaminant particles. As a result, electrical mobility of the contaminant particles is further decreased separation between ions and corona byproducts is enhanced.

Naturally, the above-described methods of the invention are particularly well adapted for use with the above-described apparatus of the invention. Similarly, the apparatus of the invention are well suited to perform the inventive methods described above.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings wherein like numerals represent like steps and/or structures and wherein.

DETAILED DESCRIPTION OF THE PREFERRED EMBODIMENTS

Figure 1A:
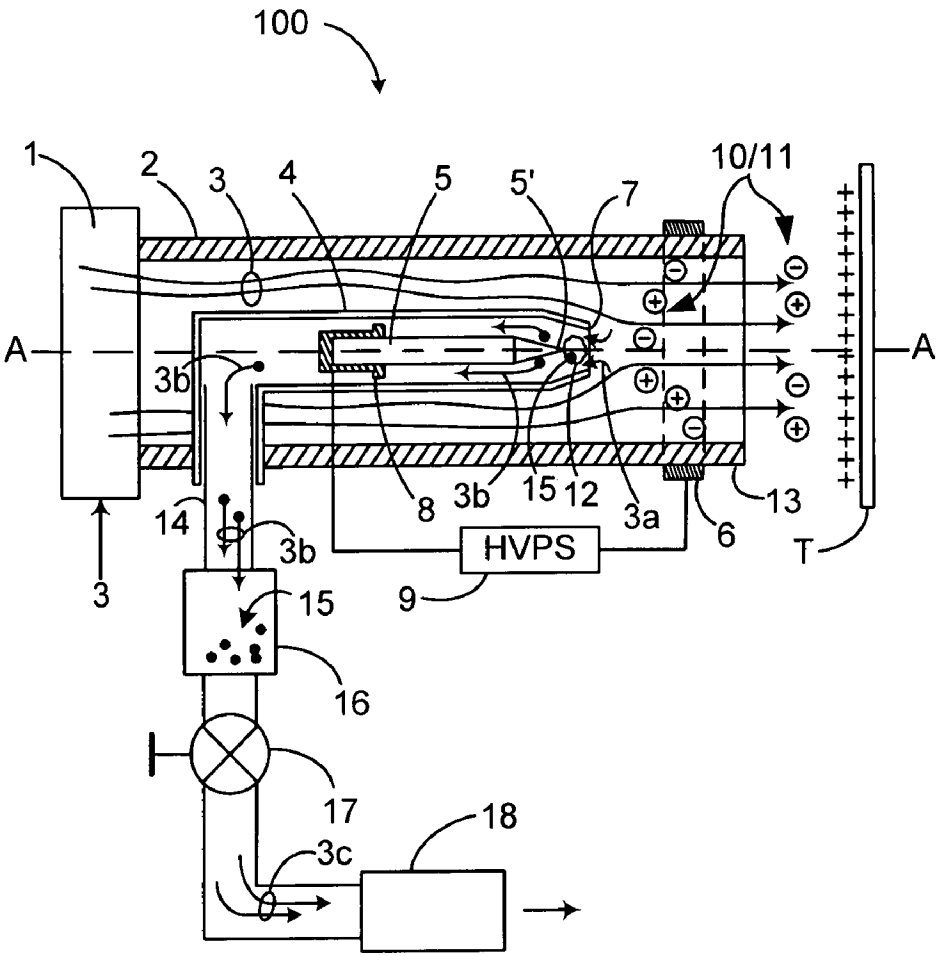
FIG. 1*a* is a schematic representation of first preferred apparatus and method embodiments for clean corona gas ionization for static charge neutralization.

FIG. 1*a* is a schematic representation of first preferred method and apparatus embodiments of the invention. Cross-sectional elevation and perspective views of FIGS. 3*a* and 3*b* conveying various structural details of the inventions represented by FIG. 1*a* and reference to these Figures is, therefore, also made.

As shown in the aforementioned Figures, an inventive in-line ionization cell 100 includes at least one emitter (for example, an ionizing corona electrode) 5 received within a socket 8 and both are located inside a hollow emitter shell 4. The electrode/emitter 5 may be made from a wide number of known metallic and non-metallic materials (depending on the particular application/environment in which it will be used) including single-crystal silicon, polysilicon, etc. The emitter shell 4 is preferably positioned coaxially along axis A-A inside a preferably highly resistive through-channel 2 that defines a passage for gas flow therethrough. As an alternative, through-channel 2 may be largely comprised of a semi-conductive or even a conductive material as long as a non-conductive skin or layer lines at least the inner surface thereof. These components along with a reference electrode 6, an outlet 13 for gas flow 3 and an evacuation port 14 serve as an ionization cell where corona discharge may occur and ionization current may flow. A source of high-pressure gas (not shown in FIG. 1*a*) may supply a stream of clean gas 3, such as CDA (clean dry air) or nitrogen (or another electropositive gas), through intake port 1 and into through-channel 2 at a high volume in the range of about 30 to 150 liters/min. However, rates in the range of about 40 to 90 liters/min are most preferred.

Gas ionization starts when an AC voltage output of high voltage power supply (HVPS) 9 that exceeds the corona threshold for the emitter 5 is applied to emitter tip 5' via socket 8. As is known in the art this results in the production of positive and negative ions 10, 11 by AC (or, in alternate embodiments, DC) corona discharge in a generally spherical plasma region 12 in the vicinity of and generally emanating from emitter tip 5'. In this embodiment, power supply 9 preferably applies to electrode 6 a non-ionizing electrical potential with an AC component and a DC component ranging and from about zero to 200 volts depending on various factors including whether an electropositive non-ionized gas is used. Where the non-ionized gas is air, this non-ionizing voltage may swing below zero volts. Electrically insulated reference electrode 6 is preferably disposed about the outer surface of through-channel 2 to thereby present a relatively low intensity (non-ionizing) electric field at, and in addition to the ionizing electric field that formed, the plasma region. In this way, electrical (and inherent diffusion) forces induce at least a substantial portion of ions 10, 11 to migrate from plasma region 12 into the ion drift region (through outlet orifice 7 of shell 4 and toward reference electrode 6). Since the intensity of the electrical field is low in proximity to electrode 6, ions 10, 11 are swept into main (non-ionized) gas stream 3 (to, thereby for a clean ionizied gas stream) and directed downstream through an outlet nozzle 13 and toward a neutralization target surface or object T. Optionally, outlet nozzle 13 of through-channel 2 may be configured like a conventional ion delivery nozzle.

As shown in FIG. 1*a*, an evacuation port 14 may be in gas communication with emitter shell 4 at one end thereof and with a vacuum line 18 which is maintained at a pressure that is lower than the gas pressure in the vicinity of the emitter shell orifice 7 as well as the gas pressure of the main gas stream 3 external to emitter shell 4. Also shown in FIG. 1*a*, other optional components, such as a contaminant byproduct filter 16 and/or an adjustable valve 17, may be located between port 14 and line 18. The optional filter 16 may be a high efficiency filter or group of filters, such as a cartridge filters rated at 99.9998% for particles above 10 nm in size.

In a preferred embodiment of ionization cell 100, emitter 5 (or some other equivalent ionizing electrode) receives high voltage AC with a sufficiently high frequency (for example, radio-frequency) so that the resulting corona discharge produces or establishes a plasma region with ions 10, 11 of both positive and negative polarity. This is preferably substantially electrically balanced so that the contaminant byproducts are substantially charge-neutral and entrained within the plasma region. In embodiments employing clean-dry-air as the non-ionized gas stream, the plasma region consists essentially of positive and negative ions and contaminant particles, because any electrons that may momentarily exist as a result of corona discharge are substantially entirely and substantially instantaneously lost due to combination with the oxygen of the air. By contrast, embodiments employing electropositive gas(es) as the non-ionizied gas stream (such as nitrogen) enable the plasma region to comprise, positive and negative ions, electrons and contaminant byproducts.

As is known in the art, this corona discharge also results in the production of undesirable contaminant byproducts 15. It will be appreciated that, were it not for protective emitter shell 4, byproducts 15 would continuously move into gas stream 3 of through-channel 2 due to ionic wind, diffusion, and electrical repulsion forces emanating from tip 5' of emitter 5. Eventually, contaminant byproducts 15 would be swept into the non-ionized gas stream 3 along with newly created ions and thereby directed through nozzle 13 and toward the charge neutralization target object T.

Due to the presence of emitter shell 4 and lower gas pressure presented by evacuation port 14, however, the gas flow pattern within and/or in the vicinity of plasma region 12 produced by emitter tip 5' prevents contaminants 15 from entering the gas stream 3. In particular, the configuration shown in FIG. 1*a* creates a pressure differential between the non-ionized gas stream in the vicinity of orifice 7 and plasma region 12 (within shell 4). Because of this pressure differential, a portion 3*a* of high velocity gas flow 3 seeps from channel 2, through orifice 7 and into shell 4. This gas stream 3*a* creates a drag force that induces substantially all of corona-generated byproducts 15, from plasma region 12, into evacuation port 14. The resulting contaminated gas stream with contaminant byproducts 15 carried therein is designated with reference numeral 3*b* throughout the Figures. Those of ordinary skill will appreciate that byproducts 15 are subject to the same ionic wind, diffusion, and electrical forces that urge ions 10, 11 into the main gas stream as discussed above. However, the present invention is intended to create conditions under which gas stream portion 3*a* strong enough to overcome such opposing forces. As a consequence, ions 10 and 11, and byproducts 15 are aerodynamically and electrically separated and move in different directions: positive and negative ions 10, 11 into the non-ionized gas stream to thereby form an ionized gas stream flowing downstream toward the charged object T. By contrast, byproducts 15 are evacuated and/or swept toward evacuation port 14 and, preferably, to byproduct collector, filter or trap 16.

As shown in FIG. 1*a*, filter 16 is preferably connected to an adjustable valve 17 and a source of low-pressure gas flow or vacuum line 18. In this case, low-pressure gas stream 3*b* continuously carries byproducts 15 from plasma space 12 into evacuation port 14 and filter 16. Once gas stream 3*b* has been filtered, the resulting clean gas stream 3*c* may be exhausted elsewhere or recirculated into gas stream 3 as discussed in detail below. The preferred filter for use in the various preferred embodiments is model DIF-MN50 manufactured by United Filtration System Inc., 6558 Diplomat Drive, Sterling Heights, Mich. 48314 USA and this filter/trap may be used to trap/collect/catch particulate contaminants as small as 10 nanometers.

For efficient removal of corona-produced byproducts from the emitter shell to occur, it is preferred to have a certain minimum pressure flow 3*a*/3*b*. Nonetheless, this flow will preferably still be small enough to permit at least a substantial portion of ions 10, 11 migrating out of plasma region 12 toward non-ionizing reference electrode 6. In this regard, it is noted that, as is known in the art, ion recombination rates of about 99% are common and, therefore, even less than 1% of ions may be considered a substantial portion of the ions produced given the context. The low-pressure gas flow 3*a*/3*b* is preferably in the range of about 1-20 liters/min. Most preferably, flow 3*a*/3*b* should be about 4-12 liters/min to reliably evacuate a wide range of particle sizes (for example, 10 nanometers-1000 nanometers).

As noted above, channel 2 is preferably made from highly resistive electrically-insulating material such as polycarbonate, Teflon®, ceramics or other such materials known in the art. As shown in FIG. 1*a*, non-ionizing reference electrode 6 is preferably configured as a narrow metal band or ring embedded within the wall of channel 2. Alternatively, reference electrode 6 may be located outside of (for example, on an outer surface of) the channel 2. Regardless, reference electrode 6 may be connected to a control system of the apparatus (not shown in FIG. 1*a*, see, for example, FIG. 7) or to a low voltage (for example, ground) terminal of power supply 9. The electrical potential received by emitter 5 may be in the range of about 3 kilovolts to about 15 kilovolts and is typically about 9 kilovolts. The electrical potential received by the reference electrode is in the range of about 0 volts to about 200 volts, with about 30 volts being typical.

It is noted that a radio-frequency ionizing potential is preferably applied ionizing electrode 5 through a capacitor. Similarly the reference electrode/ring 6 may be "grounded" through a capacitor and inductor (and LC circuit) from which a feedback signal can be derived. This arrangement, thus, presents an electric field between ionizing electrode 5 and non-ionizing electrode 6. When the potential difference between electrodes is sufficient to establish corona discharge, a current will flow from emitter 5 to reference electrode 6. Since emitter 5 and reference electrode 6 are both isolated by capacitors, a relatively small DC offset voltage is automatically established and any transient ionization balance offset that may be present will diminish to a quiescent state of about zero volts.

Figure 1B:
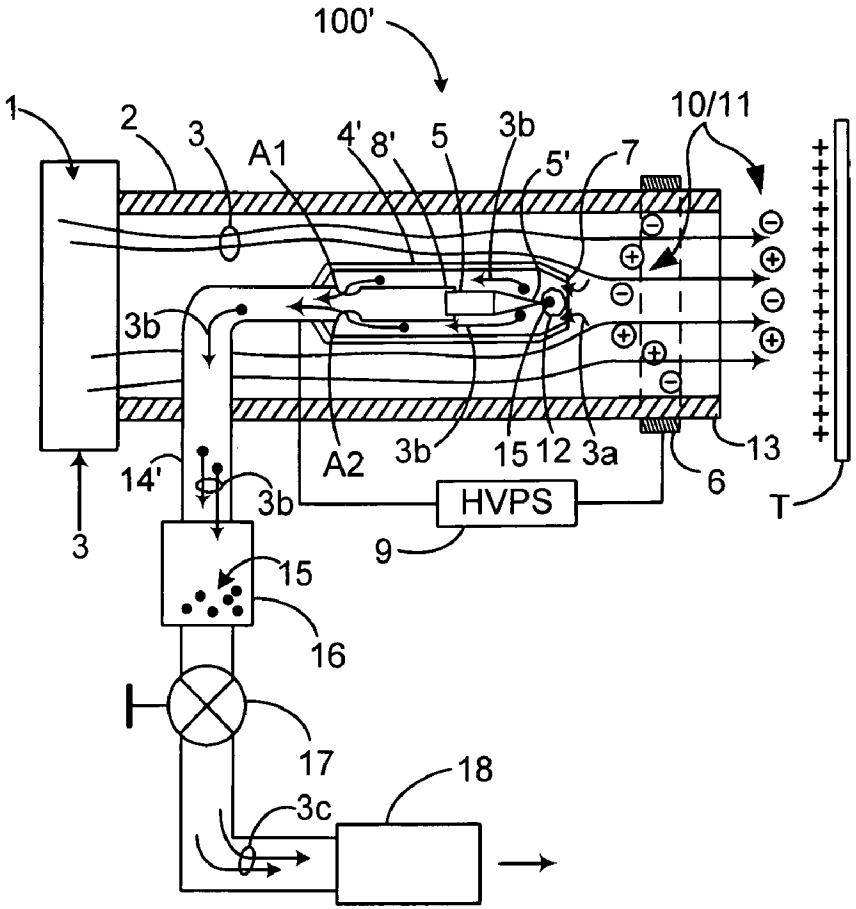
FIG. 1*b* is a schematic representation of second preferred apparatus and method embodiments for clean corona gas ionization for static charge neutralization.

FIG. 1*b* is a schematic representation of second preferred method and apparatus embodiments of the invention. As indicated by the use of like reference numerals, the inventive in-line ionization cell 100' of FIG. 1*b* is substantially similar in structure and function as that of cell 100 of FIG. 1*a*. Accordingly, the discussion of cell 100 above also applies to cell 100' except for the differences expressly discussed immediately below. As shown in FIG. 1*b*, emitter shell 4', socket 8' and evacuation port 14' differ from their respective components of cell 100. In particular, cell 100' preferably envisions the use of an evacuation port 14' in which socket 8', for supplying high voltage from power supply 9 to emitter 5, is integrally formed therewith. Moreover, port 14/socket 8 may take the form of a hollow tube that defines at least one (and preferably multiple) apertures positioned so that they are disposed within emitter shell 4'. In this way, low-pressure byproduct stream may be evacuated through port 14' via the aperture(s) A1 and/or A2.

Figure 1C:
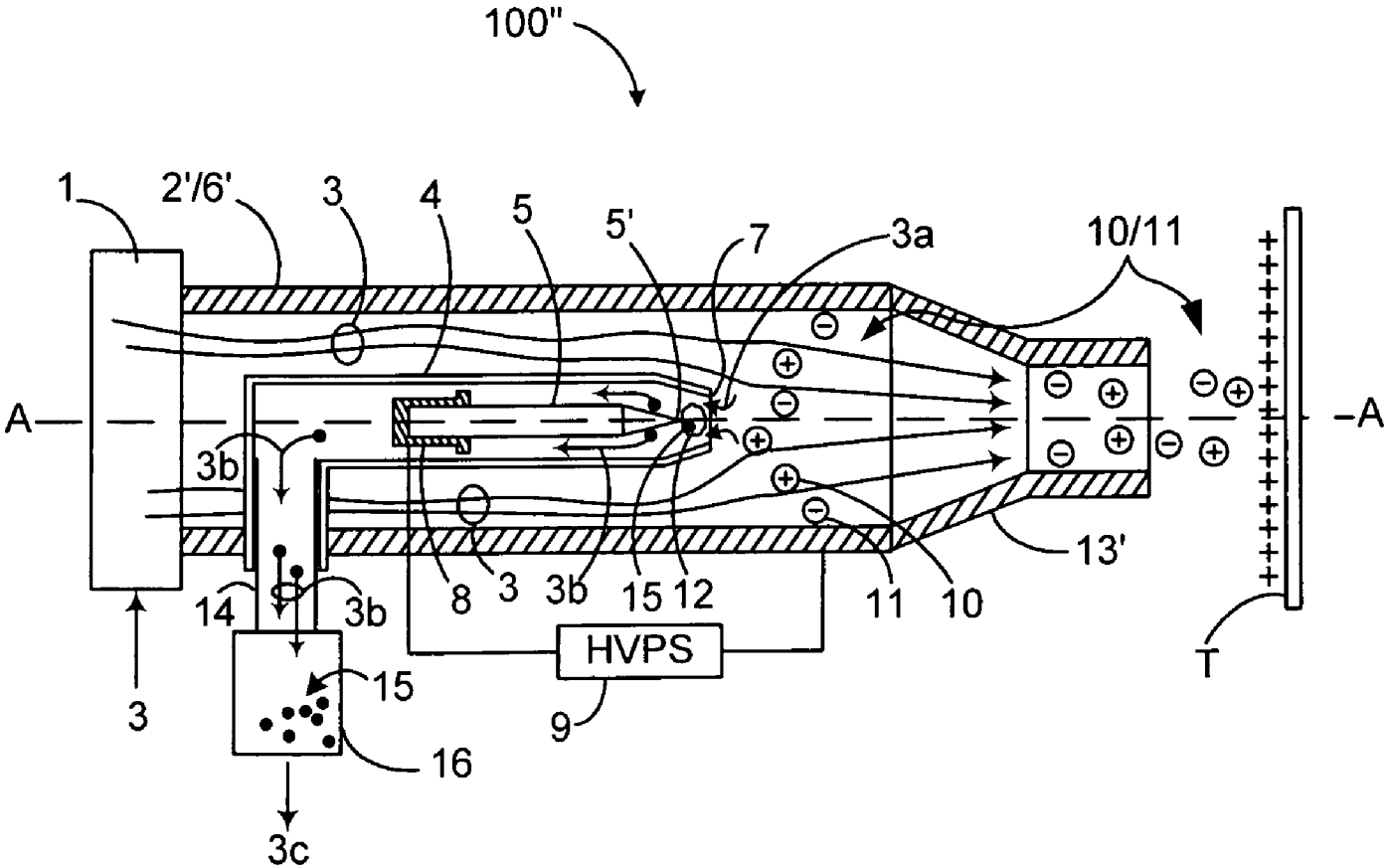
FIG. 1*c* is a schematic representation of third preferred apparatus and method embodiments for clean corona gas ionization for static charge neutralization.

FIG. 1*c* is a schematic representation of third preferred method and apparatus embodiments of the invention. As indicated by the use of like reference numerals, the inventive in-line ionization cell 100" of FIG. 1*c* is substantially similar in structure and function as that of cell 100 of FIG. 1*a*. Accordingly, the discussion of cell 100 above also applies to cell 100' except for the differences expressly discussed immediately below. As shown in FIG. 1, through-channel and reference electrode 2'/6' and output nozzle 13' differ from their respective components of cell 100. In particular, cell 100" preferably envisions the use of a conductive channel 2'/6' that also serves the function of an integrally formed reference electrode. As such, conductive channel 2'/6' may receive an operating voltage from the low-voltage terminal of the power supply 9. Additionally, output nozzle 13' may be configured like a nozzle (or a manifold) with a smaller cross section than channel 2'/6'. This configuration creates positive pressure in the vicinity of orifice 7 of emitter shell 4 which, in turn, enables cell 100" to function as desired regardless of whether evacuation port 14 is in gas communication with line 18 or simply in gas communication with the ambient atmosphere. In either case, port 14 presents a pressure lower than that of the gas pressure in the vicinity of orifice 7. In light of the discussion herein, those of ordinary skill will appreciate that one may also incorporate evacuation port 14' and socket 8' of cell 100' above into cell 100" as an additional variation.

Figure 2A:
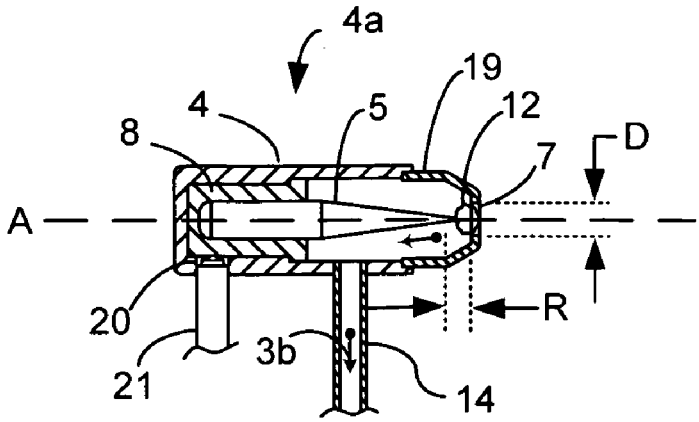
FIGS. 2*a*, 2*b*, 2*c* are schematic representations showing three alternative embodiments of the emitter shell assemblies for use in the preferred embodiments depicted in any one or more of FIGS. 1*a*-1*c;*
Figure 2B:
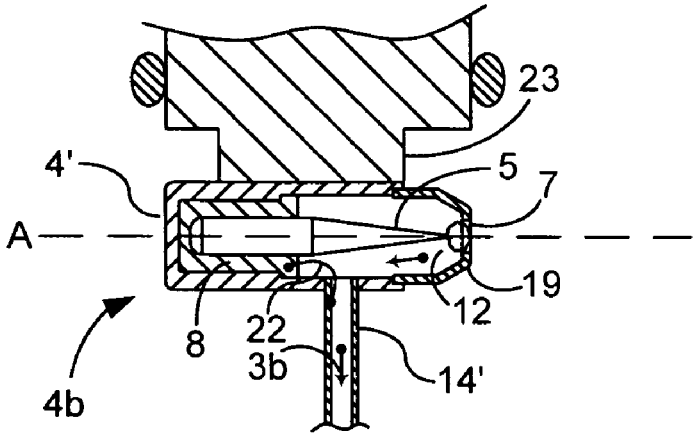
Figure 2C:
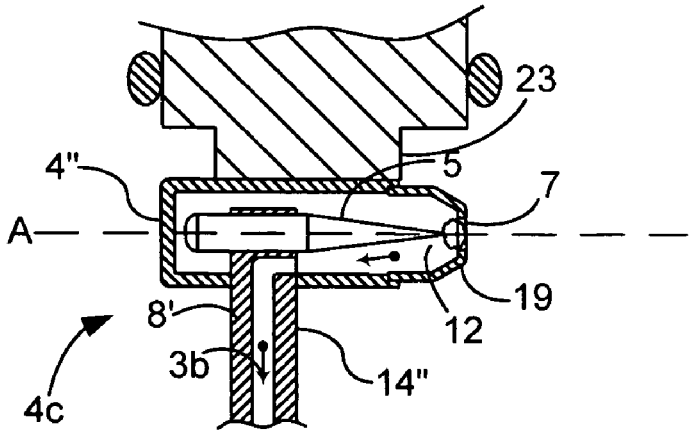

The structure of several variant emitter shell assemblies 4*a*, 4*b* and 4*c* will now be presented in greater detail with joint reference to FIGS. 2*a*, 2*b* and 2*c*. As shown therein, the invention envisions that preferred shell assemblies (schematically represented in FIG. 1 as shell 4, emitter 5, socket 8, and evacuation port 14) may take any one of the three alternative designs shown in FIGS. 2*a*, 2*b* and 2*c*. In all of these alternatives, the hollow shell 4 will preferably have an aerodynamic exterior surface (for example, such as an ellipsoid or a sphere) to minimize velocity drop of the high-velocity gas stream flowing around it and in through-channel 2. Any or all of shells 4, 4' and/or 4" may be made of an insulating material and preferably from a plasma resistive insulating material such as polycarbonate, ceramic, quartz, or glass. Alternatively, only the portion of shells 4, 4' and/or 4" in the vicinity of orifice 7 may be made from plasma resistive insulating material like polycarbonate, ceramic, quartz, or glass; in this case, outlet 19 and orifice 7 will preferably be made from non-conductive ceramic. As another optional alternative, some or all of each of shells 4, 4' and/or 4" may be coated with a skin of plasma resistive insulating material.

With continuing joint reference to FIGS. 2*a*, 2*b* and 2*c*, ion emitter 5 is preferably positioned along the central axis A of shell in which it is received such that the corona discharge end of emitter 5 is spaced inwardly of (or, synonymously, recessed from) orifice 7 by distance R. The greater the recess distance R, the more easily contaminant byproducts from plasma region 12 might be swept toward one of evacuation ports 14, 14' or 14" by low-pressure flow 3*a* as desired. However, the smaller the recess distance R, the more easily ions from plasma region 12 might migrate through orifice 7 and into the ion drift region of main gas stream 2 as desired. For optimum balance of these competing considerations, it has been determined that optimum ion/byproduct separation may be achieved if the distance R is selected to be equal to or larger than the size of plasma region 12 produced by corona discharge at the tip of emitter 5 (plasma region is usually about 1 millimeter across). In addition, the preferred distance R may be generally comparable to the diameter D of the circular orifice 7 (in the range of about 2 millimeters to 3 millimeters). Most preferably, the D/R ratio may range from about 0.5 to about 2.0.

Although ionizing electrode 5 is preferably configured as a tapered pin with a sharp point, it will be appreciated that many different emitter configurations known in the art are suitable for use in the ionization shell assemblies in accordance with the invention. Without limitation, these may include: points, small diameter wires, wire loops, etc. Further, emitter 5 may be made from a wide variety of materials known in the art, including metals and conductive and semi-conductive non-metals like silicon, silicon carbide, ceramics, and glass.

With particular attention now to FIG. 2*a*, it will be seen that the end of emitter 5 opposite to the sharp tip is preferably fixed in a conductive socket 8. Emitter shell 4 shown in FIG. 2*a* with an aperture 20 through which a spring-loaded pogo pin 21 may be in electrical communication with socket 8 for the delivery thereto of high-voltage from high-voltage power supply 9 (not shown in FIG. 2*a*, 2*b* or 2*c*). Further, it is noted that in this embodiment evacuation port 14 preferably extends through shell 4 generally in the vicinity of the tip of emitter 5. Also, although not shown, it is noted that assembly 4 may also include a mounting plug such as plug 23 discussed below, inter alia, with respect to FIGS. 2*b*, 2*c*, 3*a* and 3*b*. A physical embodiment of the ionization shell assembly 4 of FIG. 2*a* (as used in the schematic embodiment of the complete ionization cell 100 shown in FIG. 1*a*) is shown in perspective cross-sectional elevation and perspective views in FIGS. 3*a* and 3*e*.

FIGS. 2*b* and 2*c* show alternative shell assembly variants 4' and 4". In both of these embodiments evacuation ports 14' and 14" serve two functions: to provide electrical communication with emitter 5 and to exhaust low-pressure byproduct flow 3*b* (containing corona-generated contaminants) from the emitter shell. In these embodiments, ports 14 and/or 14' may take the form of a hollow conductive tube that is in electrical communication with socket 8. Ports 14' and/or 14" may also provide removable connection to a low-pressure source and to high voltage power supply 9. In the case of FIG. 2*b*, electrical communication occurs indirectly with the use of an intermediate conductive element 22. In the case of FIG. 2*c*, electrical communication occurs directly due to port 14" and the emitter socket being integrally formed. Finally, it is noted that, shell assemblies 4*b* and 4*c* may be placed on a mounting plug 23 for easy installation into and/or removal from main channel 2 as variously shown in FIGS. 2*b*, 2*c*, 3*a* and 3*b*. This design, therefore, provides convenient access to the ionization cell and ion emitter for maintenance and replacement (if necessary).

Figure 3A:
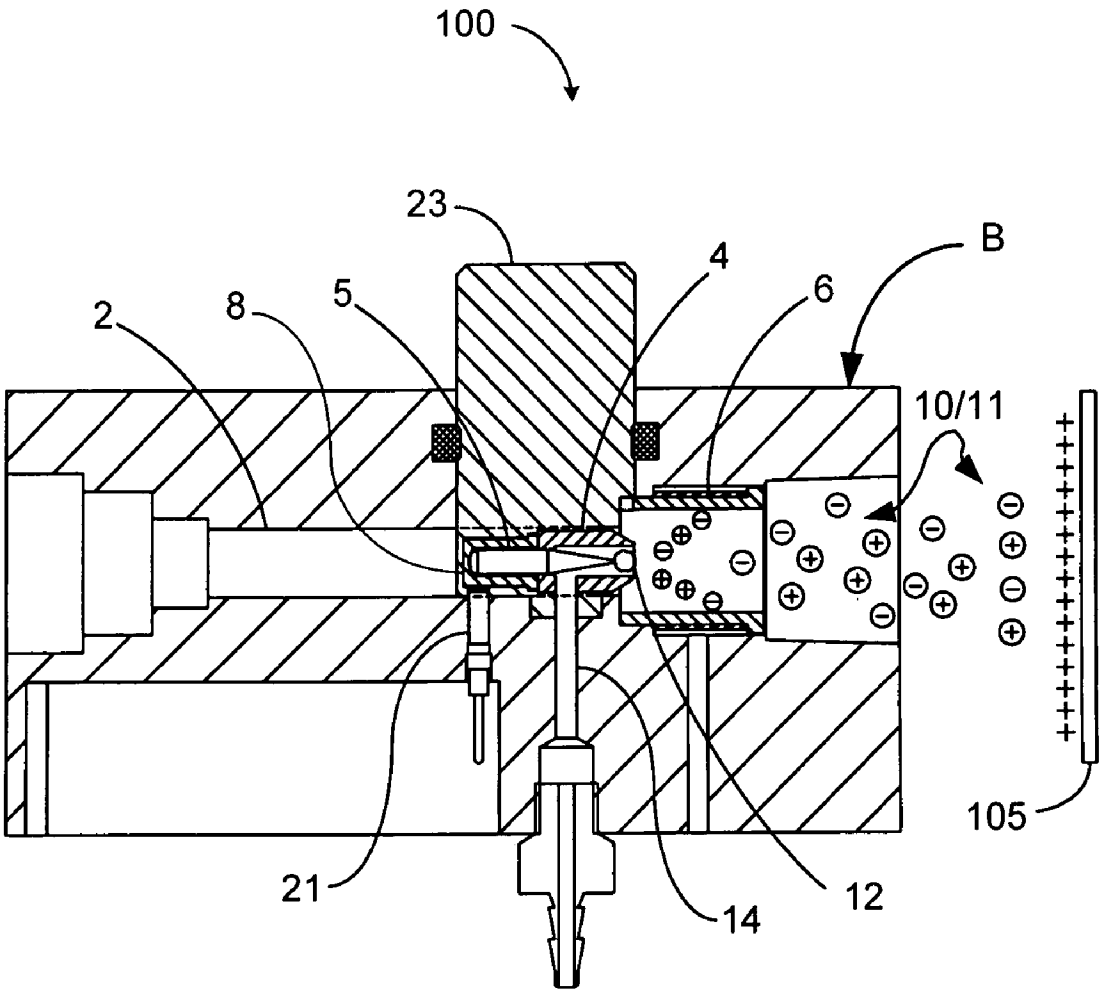
FIG. 3*a* is a partial cross-sectional elevation view of a gas ionizing apparatus with one through-channel such as those depicted in FIGS. 1*a* and 2*a;*
Figure 3B:
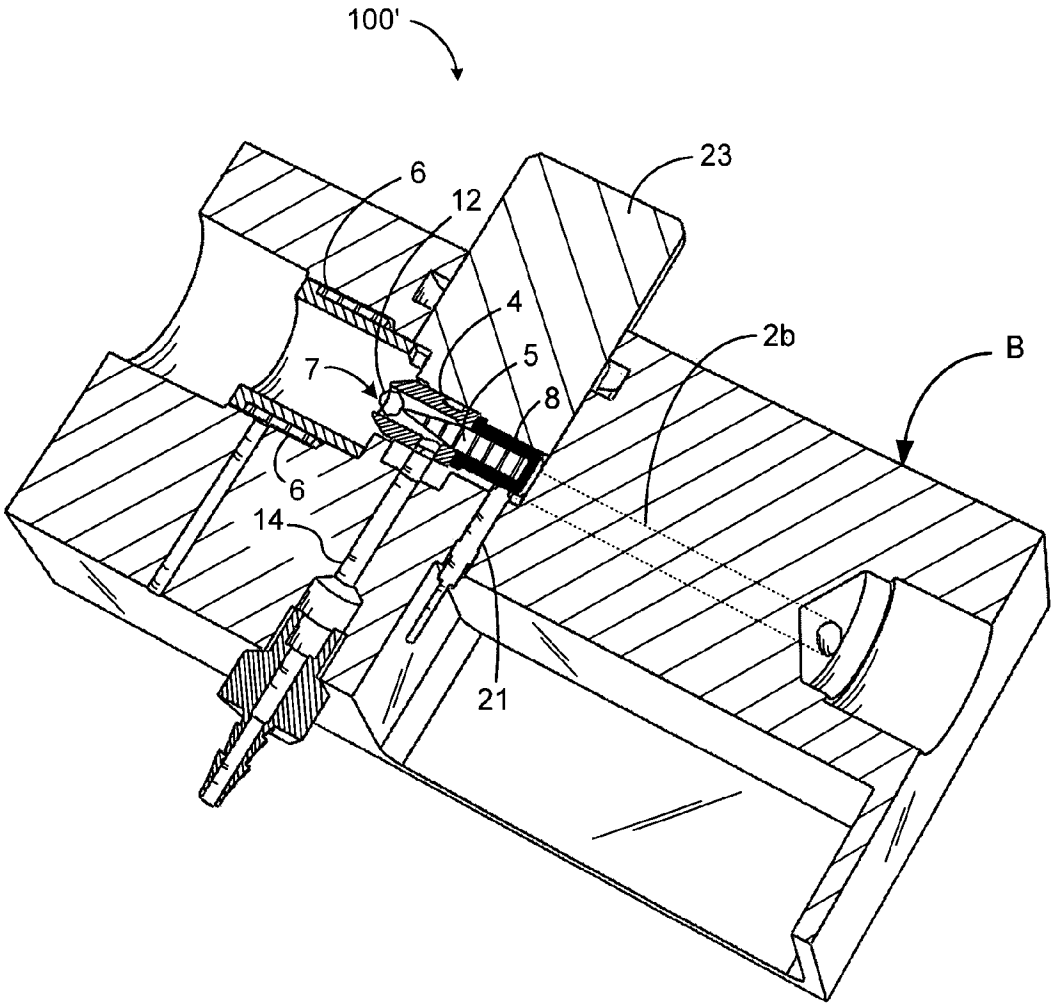
FIG. 3*b* is a cross-sectional perspective view of the general structure of the preferred gas ionizing apparatus employing two through-channels.
Figure 3C:
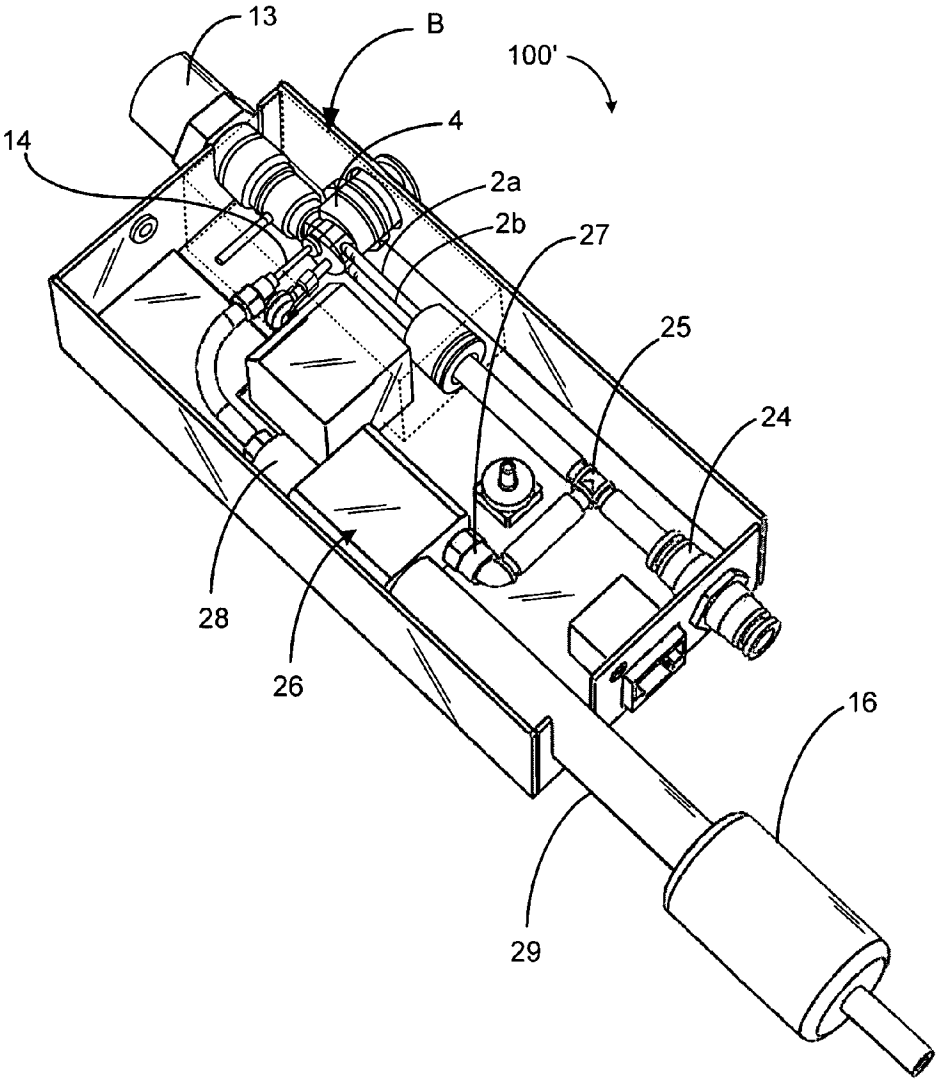
FIG. 3*c* shows the general structure of a gas ionizing apparatus with two through-channels in perspective view, the apparatus employing the design shown in FIG. 3*b;*
Figure 3D:
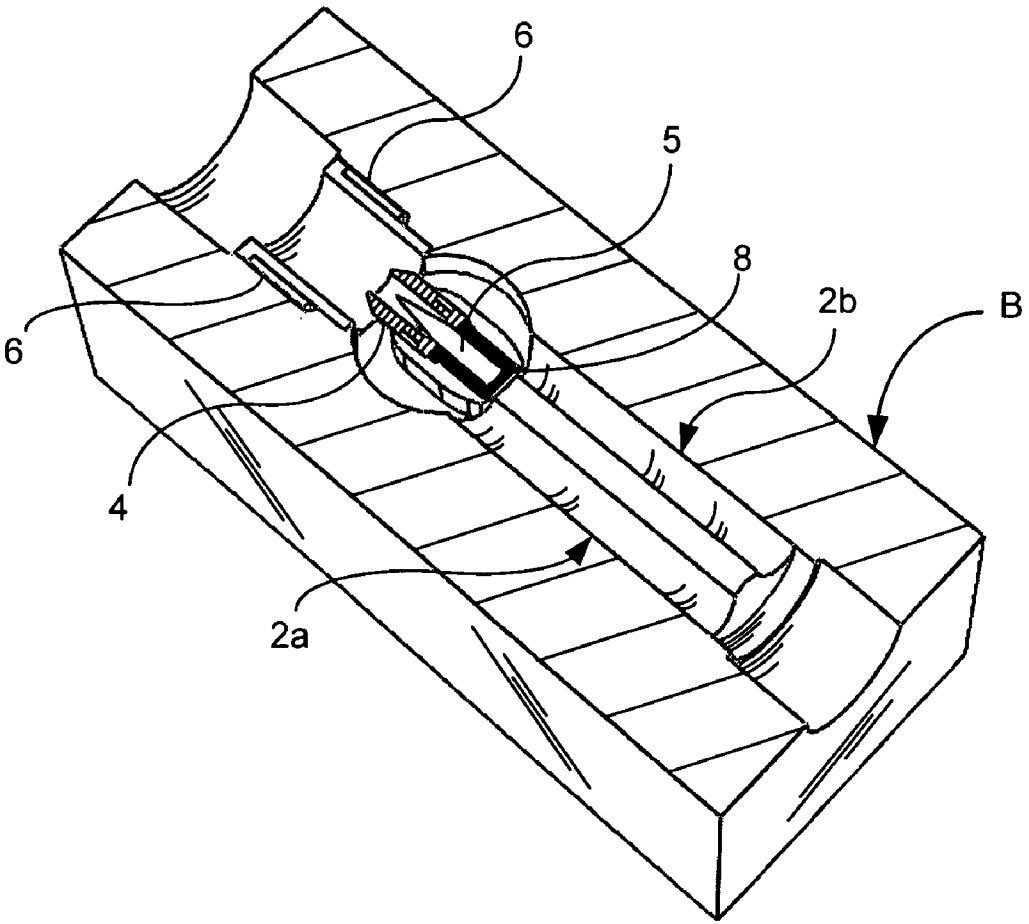
FIG. 3*d* shows another cross-sectional perspective view of the gas ionizing apparatus with two through-channels as shown in FIGS. 3*b* and 3*c;*
Figure 3E:
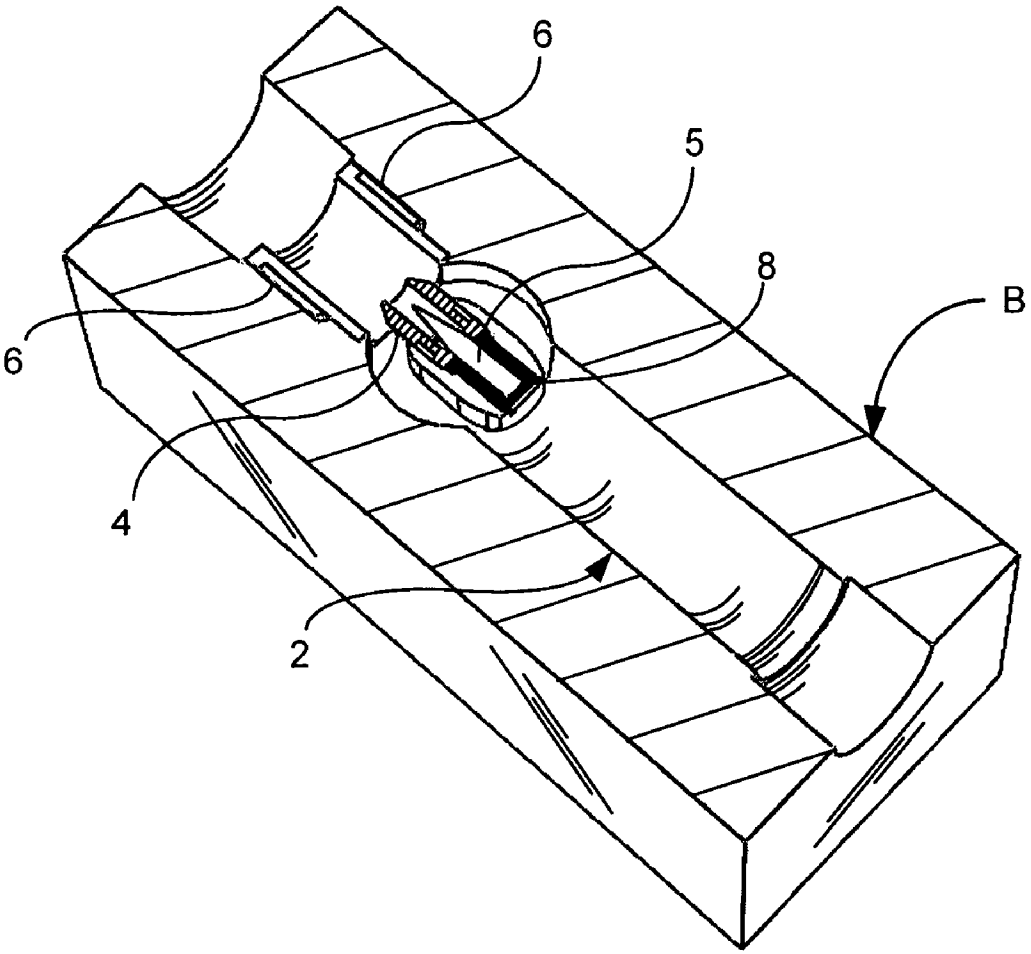
FIG. 3*e* shows another cross-sectional perspective view of the gas ionizing apparatus with one through-channel as shown in FIG. 3*a;*

With joint reference to FIGS. 3*a* and 3*e* there is shown therein various physical depictions of gas ionization apparatus with one through-channel 2. With additional joint reference to FIGS. 3*b*, 3*c* and 3*d*, there is shown therein various physical depictions of gas ionization apparatus with two parallel through-channels 2*a* and 2*b*. It is noted that both of these embodiments operate on the same principles as those discussed above with respect to, inter alia, FIG. 1*a* and the primary difference is the use of either one or two through-channels. Whereas the one through-channel embodiments are especially advantageous for the free flow of the non-ionized gas stream, the two through-channel embodiments are easier and less expensive to manufacture.

FIG. 3*a* offers a cross-sectional view of one embodiment taken along a first plane. FIG. 3*e* offers a cross-sectional view of the same embodiment taken along a second plane that is perpendicular to the first plane. FIG. 3*b* offers a cross-sectional view of a two through-channel embodiment taken along a first plane. FIG. 3*d* offers a cross-sectional view of the same embodiment taken along a second plane that is perpendicular to the first plane. It is noted that through-channel 2*a* is not visible in FIG. 3*b* because it is disposed in the portion of the apparatus that has been removed by the cross-section. The general structure of another ionizing apparatus embodiment is shown in perspective view in FIG. 3*c*. As shown therein, this apparatus embodiment includes the apparatus depicted in FIGS. 3*b* and 3*d*. However, this embodiment also includes an eductor 26 that serves as an on-board source of low-pressure gas flow for evacuation port 14, thereby dispensing with the need to connect port to any external vacuum line (such as line 18 used with respect to the above discussed embodiments). The preferred eductor for use in this embodiment of the invention is the ANVER JV-09 Series Mini Vacuum Generator manufactured and marketed by the Anver Corporation located at 36 Parmenter Road, Hudson, Mass. 01749 USA. As shown therein, the various channel(s), port(s), passages and/or bores may be manufactured by milling/drilling and/or otherwise boring a single block B of electrically insulating material such as polycarbonate, Teflon®, ceramics or other such materials known in the art (the outline of which has been shown in dotted lines to facilitate viewing of the interior of same). Alternatively, block B may be molded or otherwise formed by any other means known in the art. As further shown in FIG. 3*c*, a source of high-pressure non-ionized gas may be received by an input fitting 24 and delivered to a tee 25 (or branch) that divides the high-pressure gas flow into two parts: a main gas stream that is directed toward emitter shell 4 (substantially similar to the arrangement shown in FIG. 1*a*) and a small portion of high-pressure stream that is directed to a motive port 27 of eductor 26 via tee 25. In this embodiment, a suction connection 28 of eductor 26 supplies the low pressure gas flow for evacuation port 14 so that the contaminant byproducts flow 3*b* passing toward the eductor discharge connection 29, or exhaust, may be intercepted by filter 16. In this embodiment, cleaned gas exiting filter 16 may be exhausted to an ambient atmosphere (or, alternatively, returned to the ionizer). The main ion stream of clean ionized gas flows from the ionizing cell to the outlet pipe 13 and to the target neutralization surface or object (not shown). Although the embodiment shown in and described with respect to FIG. 3*c* is effective for the desired purpose, it does require higher gas flow than required of the alternative eductor embodiments shown in FIGS. 5*a*-5*d* and described in detail below.

Figure 4A:
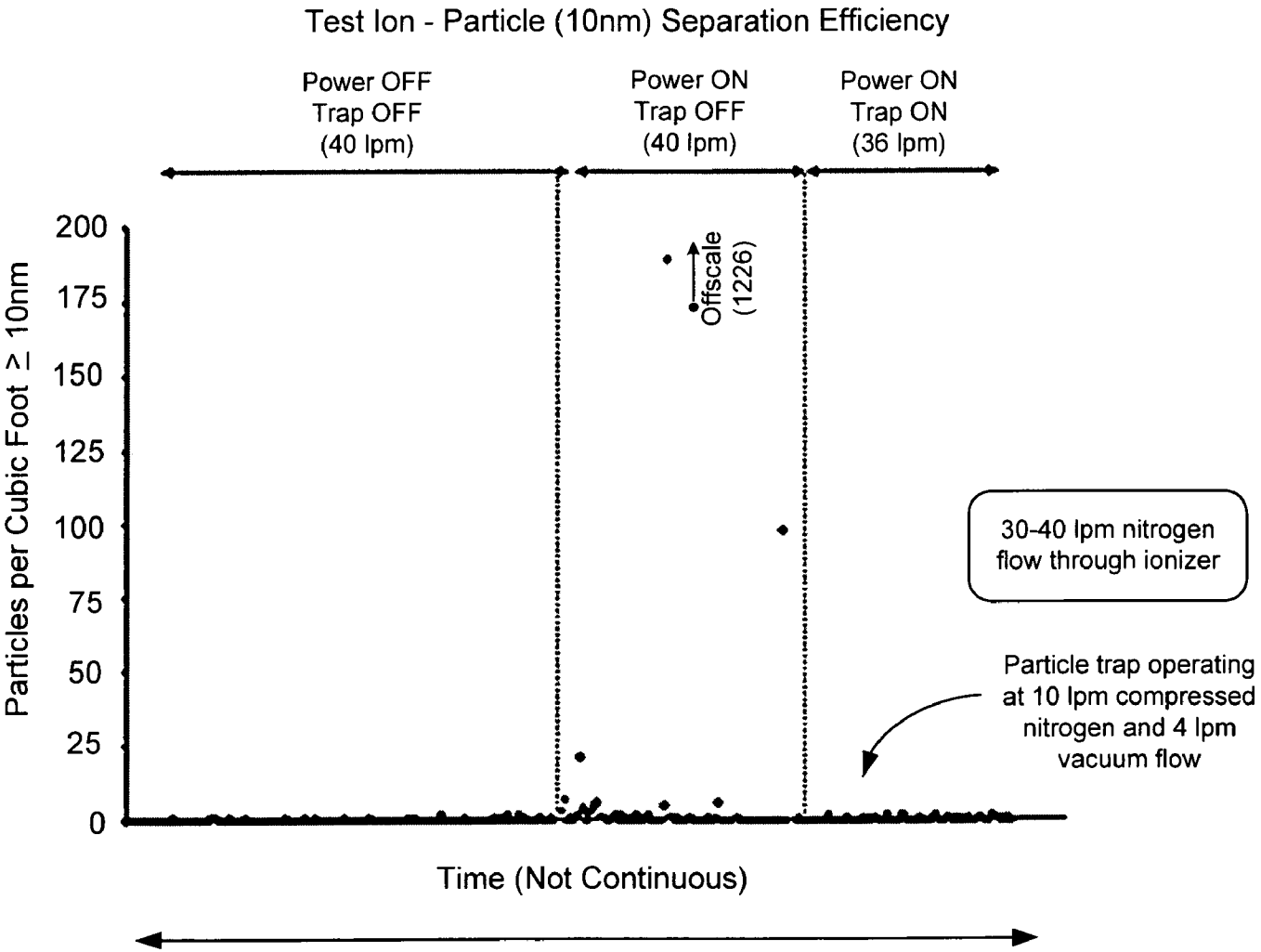
FIGS. 4*a*, 4*b* and 4*c* are charts presenting empirical test results achieved using the method and apparatus embodiments of FIG. 3*c;*
Figure 4B:
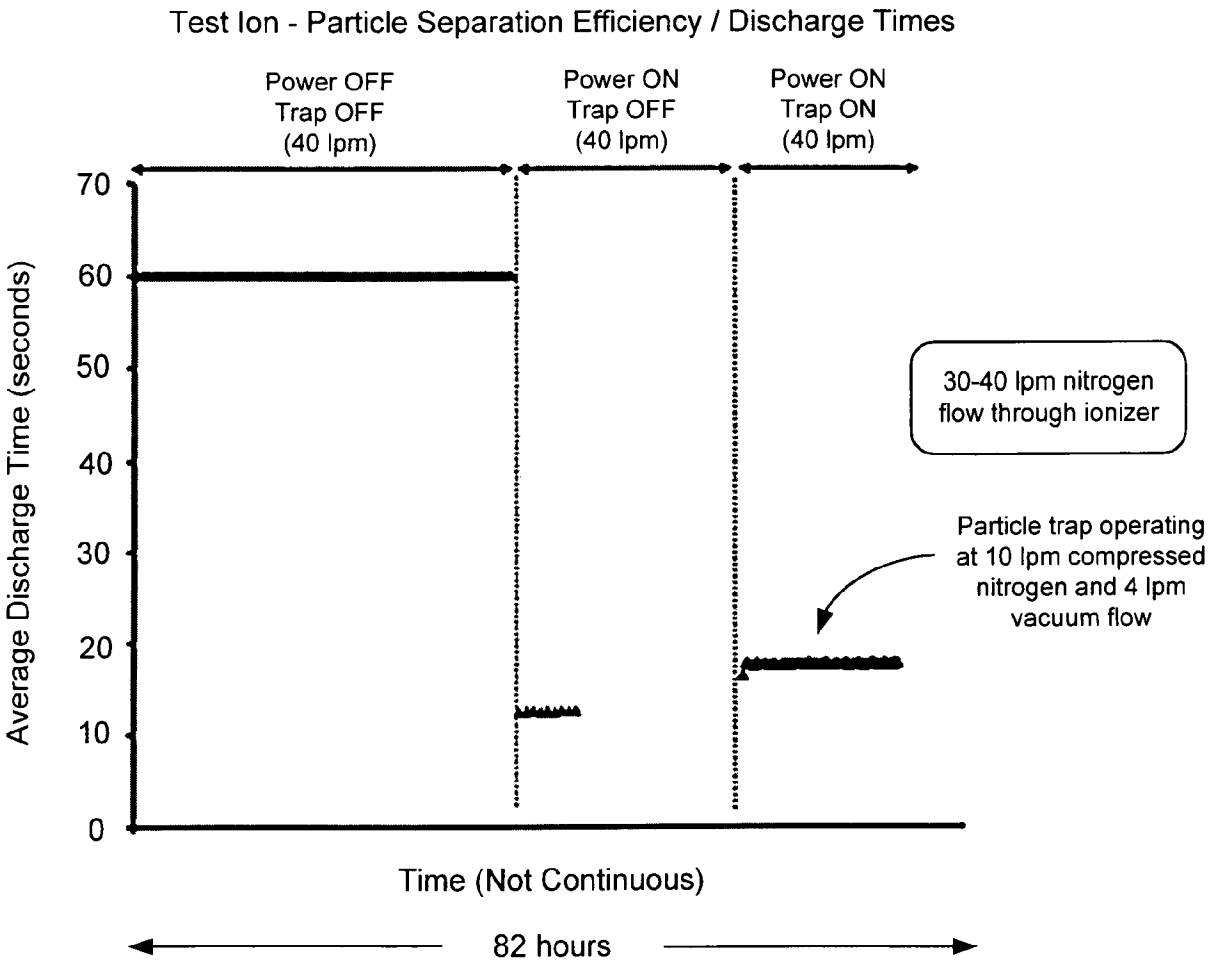
Figure 4C:
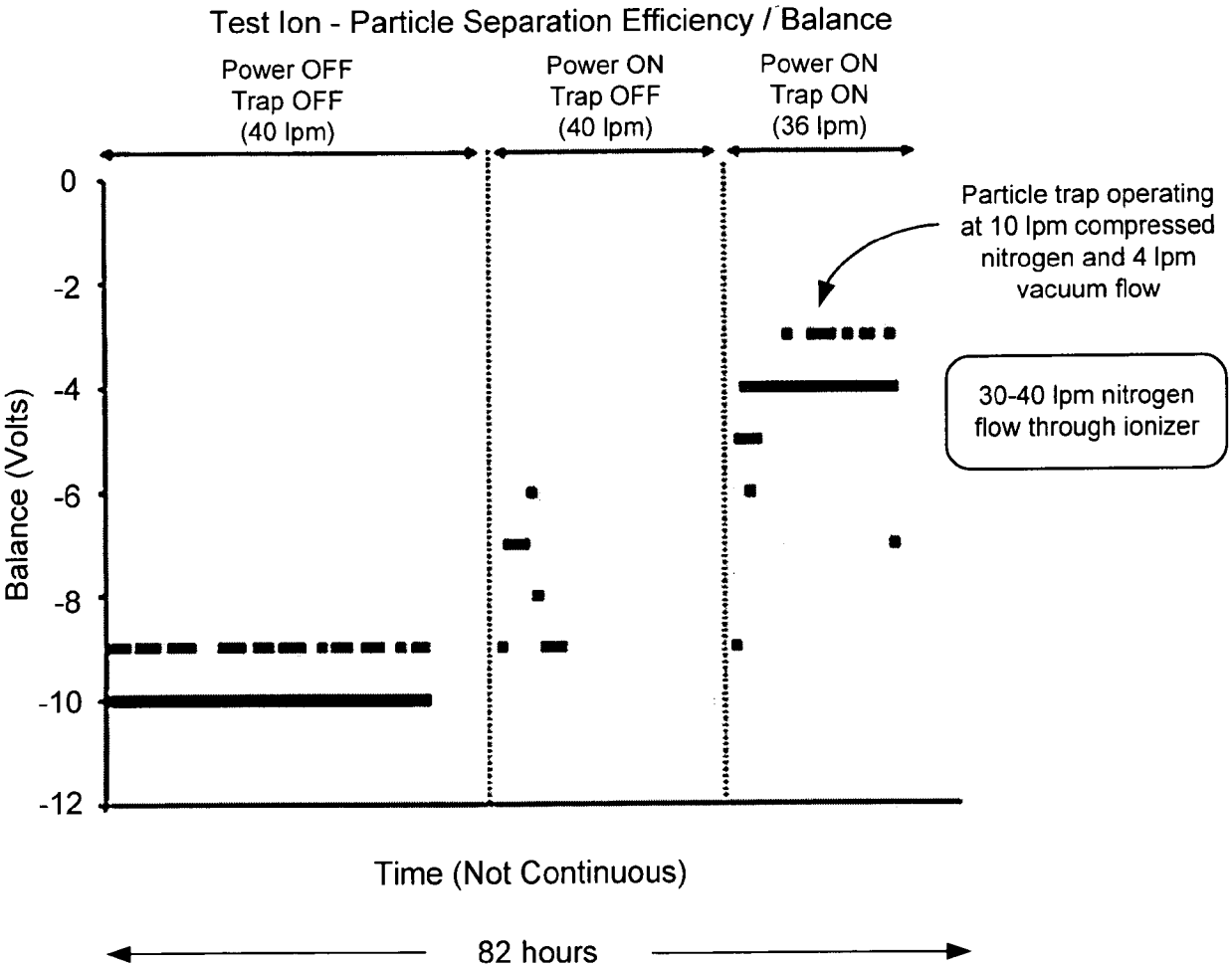

Turning now to FIGS. 4*a* through 4*c* jointly, there is shown therein test results for the inventive methods and apparatus disclosed with respect to the embodiments of FIGS. 3*b*, 3*c* and 3*d*. For this test, an inventive ionizer was installed into a 4 foot by 2 foot down-flow mini-environment, and the mini-environment was installed into a Class 1000 down-flow clean room. Hence, the background mini-environment air was double filtered and the test was performed at ISO 14644 Class 1 (at 0.1 micron). The test ionizer was positioned with the ion outlet 13 facing downward. Particle probes (either a condensation nuclei counter and/or a laser particle counter) were placed about 6 inches below the ion outlet 13, and a 10-minute sample was measured about every 15 minutes. A charge plate monitor (CPM) was placed about 12 inches below the outlet 13 and measured balance and discharge time about once every 15 minutes. As used in FIGS. 4*a*-4*c*, the term Trap refers to the byproduct separation/evaluation feature of the invention generally (as opposed to the more limited meaning of the term elsewhere as a synonym for the term filter).

With primary reference to FIG. 4*a*, a ten nanometer test begins with a background contamination check of the environment to establish a reference. This is the left-most portion of FIG. 4*a*. During this period of time, an AC high voltage power supply for the emitter and both of the non-ionized gas stream and the evacuation gas source were off (Power OFF and Trap OFF). As shown, the particle probe detected essentially no contaminant byproducts during this time.

For the duration of a second time period, the high voltage power supply for the emitter and the non-ionized gas stream are turned on (about 40 lpm of nitrogen) and the evacuation gas source remained off (Power ON and Trap OFF). This is the center portion of FIG. 4*a* and during this time separation of the ions and contaminant particles does not occur in accordance with the invention. Thus, conventional corona discharge results in the generation of positive and negative ions as well as significant levels of contaminant particles as small as ten nanometers being detected by the particle probe.

During a third time period on the right hand side of FIG. 4*a*, the high voltage power supply and the non-ionized gas stream remained on and the evacuation gas source were also turned on (Power ON and Trap ON). It will be appreciated that, during this time, the main non-ionized gas stream flows at about 40 lpm, that a T-connector taps off about 10 lpm and directs that flow to the input port of an eductor and that the suction port thereby provides about 4 lpm of evacuation flow to the evacuation port of the ionizer shell of the test apparatus. Under these conditions, ions are swept toward the target CPM by the main nitrogen gas stream where a pre-existing charge is neutralized. By contrast, the contaminant byproducts are evacuated by the evacuation gas source. As shown in FIG. 4*a*, these conditions result in virtually no byproducts being detected by the particle detector. This test, therefore, illustrates that the disclosed methods of separating corona produced contaminant particles from the gas-borne ions will typically yield 10 nanometer particle concentrations of less than about 34 particles per cubic foot, in accordance with an extrapolation (to 10 nm) of ISO Standard 14644 Class 1.

Particles greater than 100 nanometers were not measured during this test. However, substantially similar inventive ionizer tests have typically yielded 100 nanometer particle concentrations of less than about 0.04 particles per cubic foot, which complies with ISO Standard 14644 Class 1. This considered to be one non-limiting example of a concentration level achieved by removing substantially all of the contaminant byproducts While FIG. 4*a* demonstrates that the inventive methods and apparatus can effectively prevent contaminant particles from reaching a target, FIGS. 4*b* and 4*c* demonstrate that providing this feature has no more than a negligible difference in performance of the corona discharge ionizer.

As is known in the art, ionizer performance is normally quantified by two parameters: (a) discharge time and (b) charge balance. Discharge time, as measured by a CPM, is the time (in seconds) required to neutralize a 20 pF plate capacitor from 1000 V down to 100V (averaged for positive and negative voltages). Shorter discharge times indicate better performance. As shown on the left hand side of FIG. 4*b*, a discharge time of 60 seconds occurs with the ionizing electrical potential Power OFF and Trap OFF, where 60 seconds is the programmed maximum reading. As shown in the middle and right hand portions of FIG. 4*b*, discharge times increased by less than about 3 seconds when the test moved from the Power ON and Trap OFF condition (about 13 seconds) and into the Power ON and Trap ON condition (about 16 seconds).

Balance describes the ability of an ionizer to deliver equal numbers of positive and negative ions to a target. An ideal ionizer has a balance of zero volts, and well-balanced ionizers have a balance between +5 volts and −5 volts. FIG. 4*c* shows a balance of −4 volts with the inventive methods and apparatus operating in the Power ON/Trap ON condition. Accordingly, the inventive methods and apparatus have no more than a negligible effect on performance of a conventional corona discharge ionizer.

Other alternative preferred embodiments of inventive ionization cells capable of comparable performance but with lower gas consumption are schematically represented in FIGS. 5*a*, 5*b*, 5*c* and 5*d* as described below. The preferred eductor 26' for use in any and/or all of ionization cells 110*a*, 110*b*, 110*c* and 110*d* of FIGS. 5*a*-5*d* is the Fox Mini-Eductor manufactured and marketed by the Fox Valve Development Corp. located at Hamilton Business Park, Dover, N.J. 07801 USA.

Figure 5A:
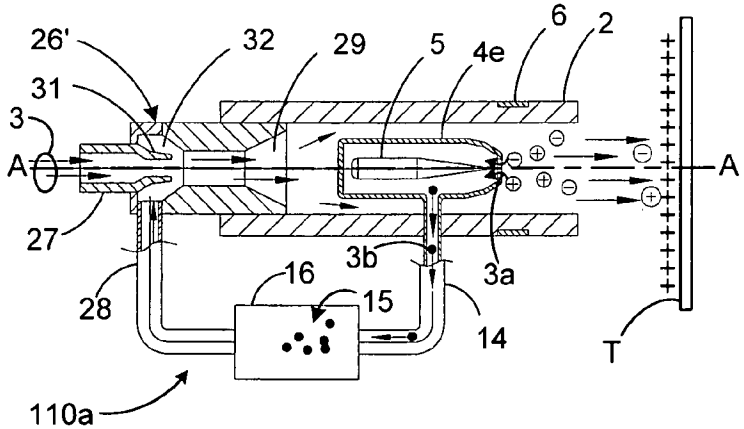
FIGS. 5*a*, 5*b*, 5*c* and 5*d* are partially cross-sectional views of showing four alternative embodiments of the emitter shell and ionizing emitter for use in the preferred embodiments depicted in FIGS. 1*a*-1*d* wherein each alternative utilizes an eductor and an emitter shell at various positions relative to one another.

Turning first to FIG. 5*a*, the ionization cell 110*a* shown therein has a high-pressure gas inlet in gas communication with a motive connection/inlet 27 of eductor 26'. In this configuration, high-speed gas 3 flowing through an educator nozzle 31 creates a relatively high vacuum inside an expansion chamber 32. A suction connection 28 of eductor 26 is in gas communication with a corona byproduct (particle) trap or filter 16 which, in turn, is in gas communication with evacuation port 14 of shell assembly 4*e*. In this way, gas flow 3*a* entering shell assembly 4*e* becomes contaminant gas flow 3*b*. It is then purified by filter 16 and then recirculated into the main gas stream 3 via connection 28. Also as shown, the eductor discharge connection 29 is positioned in-line with the through-channel 2. One advantage of this system is that all incoming gas passes through eductor 26' to efficiently create a vacuum. Moreover, gas stream velocity is maximized outside of shell assembly 4*e* and inside of through-channel 2. As a result, both ion output and byproduct removal are at optimized.

Figure 5B:
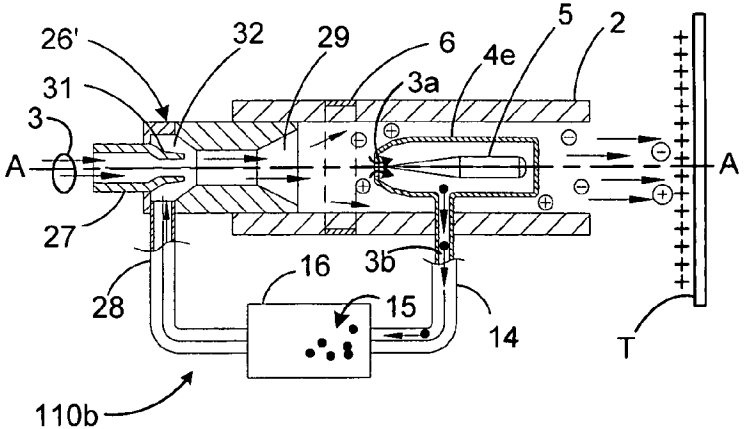

FIG. 5*b* shows an alternative orientation of shell assembly 4*e* relative to the eductor outlet 29 (exhaust connector). As shown, in this embodiment orifice 7 of shell assembly 4*e* is positioned downstream of eductor outlet 29 and ionizing emitter 5 is oriented in the opposite direction of main gas stream 3. As a result, a portion 3*a* of the main gas flow is forced into emitter shell assembly 4*e* and that gas flow 3*a* further decreases the possibility that corona byproducts may escape from shell assembly 4*e*. As a consequence, two distinct forces (incoming aerodynamic gas flow and vacuum flow) urge contaminant particles and other corona byproducts in shell assembly 4*e* into the evacuation port 14 and, eventually, to filter 16.

Figure 5C:
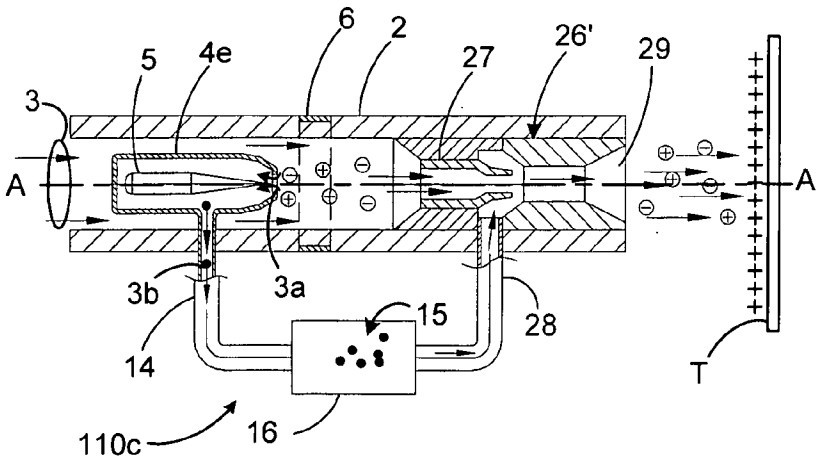

FIG. 5*c* shows yet another alternative preferred ionizer embodiment in which the eductor motive connection 27 is positioned downstream of the shell assembly 4*e* and reference electrode 6. Those of ordinary skill in the art will appreciate that, in this embodiment, gas velocity within emitter shell assembly 4*e* is maximized and ion output is high.

Figure 5D:
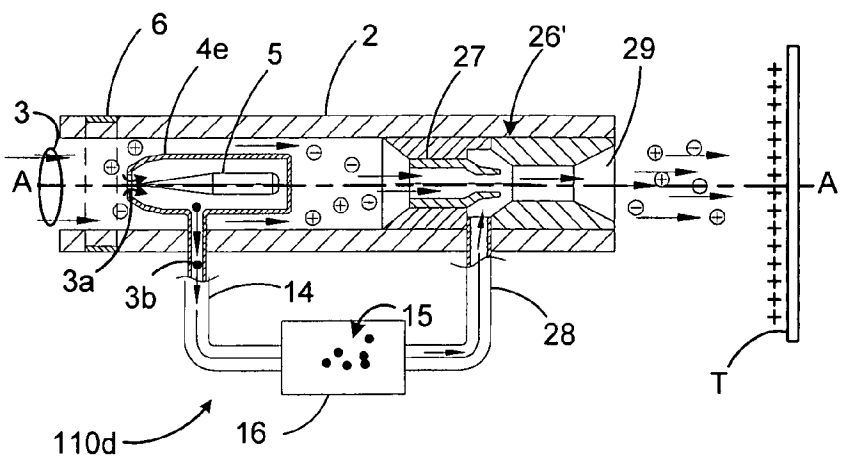

FIG. 5*d* shows another alternative arrangement combining the shell assembly orientation of FIG. 5*b* with the eductor position of FIG. 5*c*. In the embodiments of FIGS. 5*c* and 5*d*, ions must travel through the eductor 26". For this reason, most or all of eductor 26" is preferably made from highly insulating and/or corona resistive material to thereby ensure a balanced bipolar ion flow to the neutralization target. However, in the embodiments of FIGS. 5*a* and 5*b*, eductor 26' is position upstream of the ionization shell 4*e* and it may be fabricated from conductive (for example, stainless steel), semi-conductive (for example, silicon) and/or non-conductive (for example, plastic or ceramics) materials.

Figure 6:
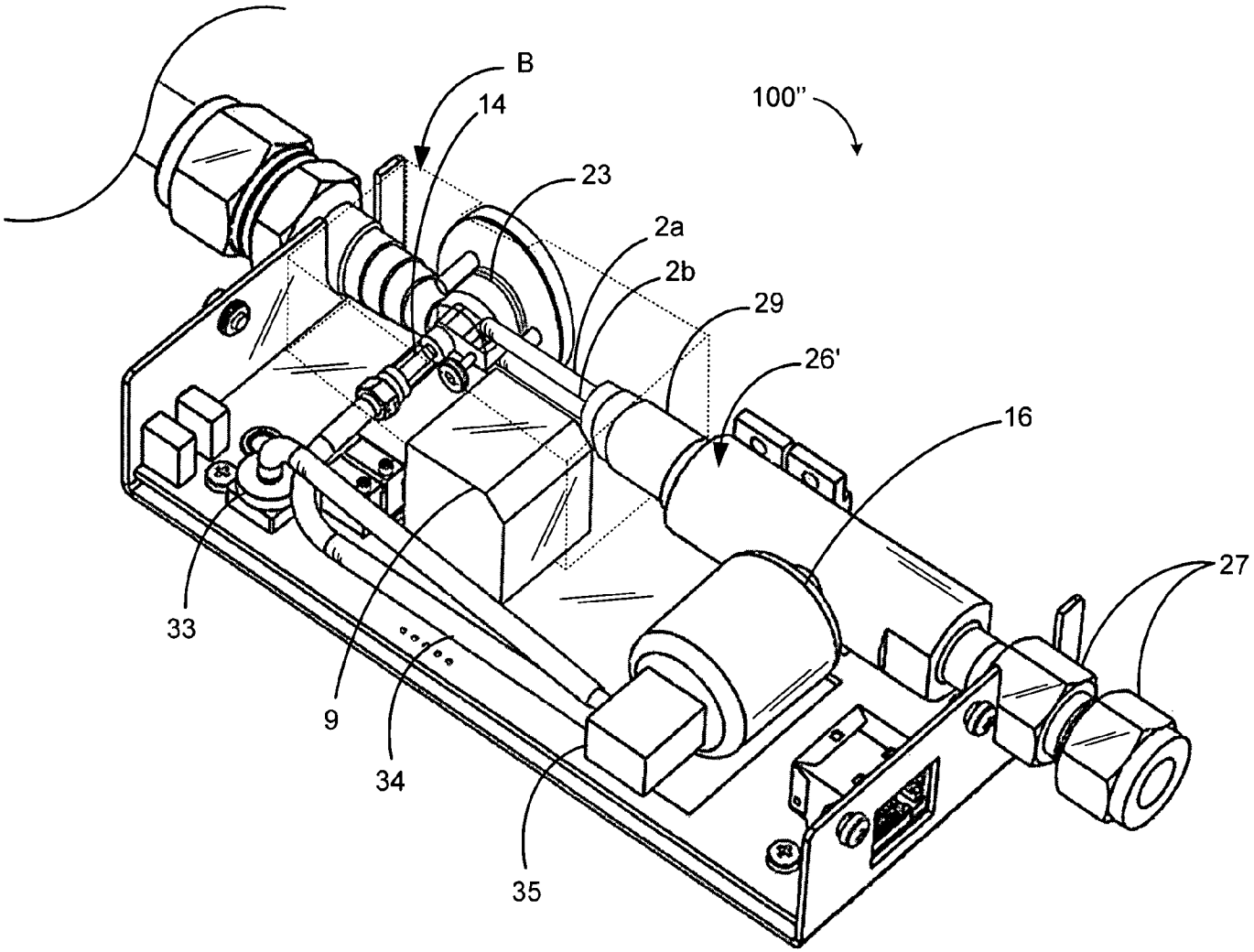
FIG. 6 is a perspective view of the general structure of the inventive gas ionizing apparatus of FIG. 5*a*, the apparatus having two through-channels and an eductor positioned upstream of an emitter shell.

The physical structure of an in-line ionization cell similar to that discussed above with respect to FIG. 5*a* is shown in perspective view in FIG. 6. In this embodiment, non-ionizing gas stream 3 is supplied to inlet 27 of eductor 26' and an eductor suction connection 28 is in gas communication with filter 16. The preferred eductor for use in this embodiment of the invention is the Fox Mini-Eductor manufactured and marketed by the Fox Valve Development Corp. located at Hamilton Business Park, Dover, N.J. 07801 USA. While the Fox Mini-Eductor may be modified for compatibility with any of the other preferred embodiments of the present invention, the basic well-known functionality of this educator will remain unchanged. Eductor discharge connection 29 is preferably in gas communication with the main through-channel 2 and the evacuation port 14 of emitter shell 4 may be in gas communication (via flexible tubing 34) with the tee 35 and filter 16. Similarly, flexible tubing may connect tee 35 with a pressure sensor 33 and emitter shell 4 is mounted to plug 23. Sensor 33 is preferably an Integrated Pressure Sensor model MPXV6115VC6U manufactured by Freescale Semiconductor, Inc., of Tempe, Ariz. 85284 USA. As shown in FIG. 6, the various channel(s), port(s), passages and/or bores may be manufactured by milling/drilling and/or otherwise boring a single block B of electrically insulating material such as polycarbonate, Teflon®, ceramics or other such materials known in the art (the outline of which has been shown in dotted lines to facilitate viewing of the interior of same). Alternatively, block B may be molded or otherwise formed by any other means known in the art.

Figure 7:
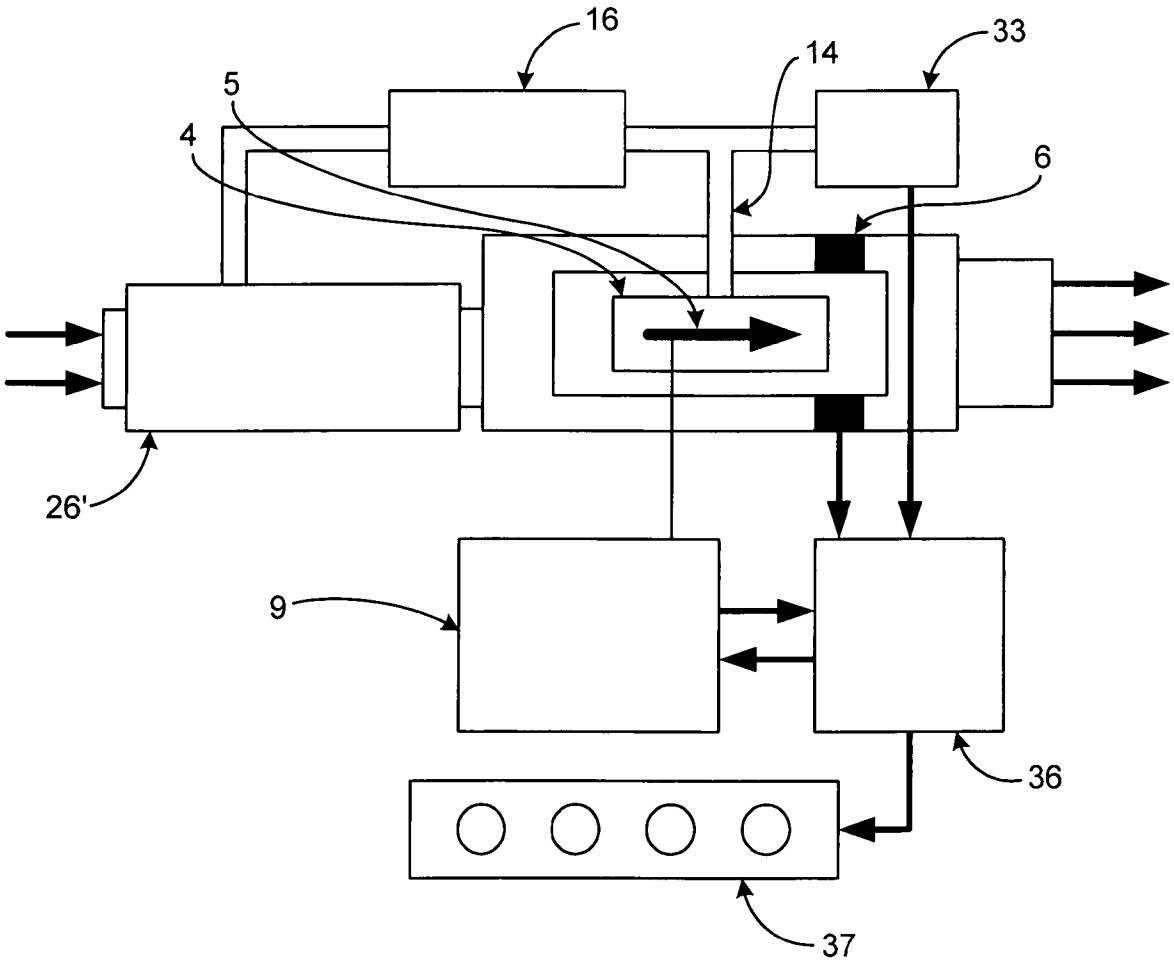
FIG. 7 is a schematic representation of a gas ionizing apparatus with vacuum sensor and control system in accordance with another preferred embodiment of the present invention.

Turning now to FIG. 7, this schematic representation illustrates still another preferred aspect of the invention which employs a closed loop control system. In this embodiment, at least one vacuum sensor 33 monitors the low pressure (vacuum) level inside emitter shell 4 via evacuation port 14. The output of sensor 33 may be communicatively linked with a microprocessor-based, controller 36 of high power supply 9. The preferred microcontroller is the ATMEGA8, manufactured by Atmel Corporation of San Jose, Calif. 95131 USA.

In operation, the microprocessor-based controller 36 uses a feedback signal derived from the reference electrode (which is indicative of the corona current), the signal from pressure sensor 33 and other signals, (for example, gas flow information, status inputs, etc.) to control the ionizing potential applied to ionizing electrode 5 by power supply 9. Further, if the pressure level inside shell 4 is other than one or more predetermined and desired conditions, control system 36 may take some action such as shutting down high-voltage power supply 9 to thereby stop ion (and contaminant) generation. Optionally, the controller 36 may also send an alarm signal to a control system of the manufacturing tool where the ionizer is installed (not shown). Optionally, controller 36 may also turn on visual (and/or audio) alarm signals on display 37. In this way, this embodiment automatically protects the target neutralization surface or object from contamination by corona generated byproducts and protects the ion emitter(s) from accelerated erosion.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims.

Therefore, the foregoing is considered to be an illustrative, not exhaustive, description of the principles of the present invention.

All of the numbers or expressions referring to quantities of ingredients, reaction conditions, etc. used in the specification and claims are to be understood as modified in all instances by the term "about." Accordingly, the numerical parameters set forth in the following specification and attached claims are approximations that can vary depending upon the desired properties, which the present invention desires to obtain.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

The discussion herein of certain preferred embodiments of the invention has included various numerical values and ranges. Nonetheless, it will be appreciated that the specified values and ranges specifically apply to the embodiments discussed in detail and that the broader inventive concepts expressed in the Summary and Claims may be scalable as appropriate for other applications/environments/contexts. Accordingly, the values and ranges specified herein must be considered to be an illustrative, not an exhaustive, description of the principles of the present invention.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary.

We claim:

1. An apparatus for separating corona discharge generated ions from discharge generated contaminant byproducts, comprising:

means for establishing a non-ionized gas stream having a pressure and flowing in a downstream direction;

means for establishing a plasma region comprising ions and contaminant byproducts, the pressure at the plasma region being sufficiently lower than the pressure of the non-ionized gas stream in the vicinity of the plasma region to prevent substantially all of the contaminant byproducts from migrating into the non-ionized gas stream; and means for superimposing a non-ionizing electric field in the plasma region sufficient to induce at least a substantial portion of the ions to migrate into the non-ionized gas stream.

2. The gas ionization apparatus of claim 1 wherein the means for establishing a plasma region further comprises means for applying an ionizing radio-frequency electric field to thereby entrain at least a substantial portion of the contaminant byproducts within the plasma region.

3. The gas ionization apparatus of claim 1 wherein the pressure at the plasma region is sufficiently lower than the pressure of the non-ionized gas stream to prevent substantially all of the contaminant byproducts from migrating into the non-ionized gas stream and insufficiently lower to prevent at least a substantial portion of the ions from migrating into the non-ionized gas stream;

the gas of the non-ionizing gas stream is an electropositive gas; and the means for establishing further comprises means for establishing a plasma region comprising electrons, positive and negative ions and contaminant byproducts.

4. The gas ionization apparatus of claim 1 wherein the means for establishing a plasma region comprises:

a shell with at least one orifice facing the downstream direction and in gas communication with the non-ionizing gas stream, the shell having at least one evacuation port that presents a gas pressure within the shell and in the vicinity of the orifice that is lower than the pressure of the non-ionized gas stream outside of the shell and in the vicinity of the orifice; and at least one ionizing electrode with a sharp point for producing a generally spherical plasma region comprising positive and negative ions and contaminant byproducts in response to application of a radio-frequency ionizing electrical potential, the point being disposed within the shell and recessed from the shell orifice by a distance that is substantially equal to or greater than the diameter of the plasma region.

5. The gas ionization apparatus of claim 4 wherein the means for superimposing a non-ionizing electric field is a reference electrode positioned upstream of the shell orifice, the non-ionized gas is an electropositive gas and the plasma region further comprises electrons.

6. The gas ionization apparatus of claim 1 wherein the non-ionized gas is an electropositive gas;

the ionizing potential is a radio-frequency ionizing electrical potential; and the ionizing electrode produces a plasma region comprising electrons, positive and negative ions and byproducts.

7. A gas ionization apparatus for converting a non-ionized gas stream into a clean ionized gas stream flowing in a downstream direction toward a charge neutralization target, the apparatus comprising:

means for establishing a non-ionized gas stream having a pressure and flowing in the downstream direction;

means for establishing a plasma region comprising ions and contaminant byproducts;

means for applying a pressure differential to the plasma region sufficient to prevent at least a substantial portion of the contaminant byproducts from migrating into the non-ionized gas stream and insufficient to prevent at least a substantial portion of the ions from migrating into the non-ionized gas stream; and means for superimposing a non-ionizing electric field in the plasma region sufficient to induce at least a substantial portion of the ions to migrate into the non-ionized gas stream and insufficient to induce at least a substantial portion of the contaminant byproducts from migrating into the non-ionized gas stream to thereby produce the clean ionized gas stream flowing in the downstream direction toward the charge neutralization target.

8. The gas ionization apparatus of claim 7 wherein the means for applying a pressure differential comprises means for applying a pressure differential to the plasma region sufficient to prevent substantially all of the contaminant byproducts from migrating into the non-ionized gas stream and insufficient to prevent at least a substantial portion of the ions from migrating into the non-ionized gas stream; and the means for superimposing a non-ionizing electric field comprises means for superimposing a non-ionizing electric field in the plasma region sufficient to induce at least a substantial portion of the ions to migrate into the non-ionized gas stream and insufficient to induce substantially any of the contaminant byproducts to migrate into the non-ionized gas stream to thereby produce the clean ionized gas stream.

9. The gas ionization apparatus of claim 7 wherein the means for applying a pressure differential comprises means for reducing the pressure at the plasma region sufficiently to prevent substantially all of the contaminant byproducts from migrating into the non-ionized gas stream and insufficiently to prevent at least a substantial portion of the ions from migrating into the non-ionized gas stream under the influence of the electric field.

10. The gas ionization apparatus of claim 7 wherein the means for establishing a plasma region comprises means for establishing a protected plasma region within the non-ionized gas stream and comprising positive and negative ions and contaminant byproducts.

11. A gas ionization apparatus for delivering a clean ionized gas stream to a charge neutralization target, the apparatus receiving at least one non-ionized gas stream having a pressure and an ionizing electrical potential sufficient to induce corona discharge, the apparatus comprising:

a said charge neutralization target;

at least one through-channel for receiving the non-ionized gas stream and an outlet nozzle positioned at a downstream end of the through-channel for delivering the clean ionized gas stream at the target; and at least one shell assembly comprising:

a shell having an orifice in gas communication with the through-channel such that a portion of the non-ionized gas stream may enter the shell;

at least one evacuation port that presents a gas pressure within the shell and in the vicinity of the orifice that is lower than the pressure of the non-ionized gas stream outside the shell and in the vicinity of the orifice; and at least one ionizing electrode for producing ions and byproducts in response to application of the ionizing electrical potential, the ionizing electrode being disposed within the shell such that at least a substantial portion of the produced ions may migrate into the non-ionized gas stream to thereby form the clean ionized gas stream and such that the evacuation port gas pressure induces a portion of the non-ionized gas stream to flow into the shell orifice to thereby sweep at least a substantial portion of the byproducts into the evacuation port.

12. The gas ionization apparatus of claim 11 wherein the apparatus further comprises at least one non-ionizing electrode for superimposing a non-ionizing electric field that induces at least a substantial portion of the ions to migrate through the shell orifice and into the non-ionized gas stream to thereby form the clean ionized gas stream.

13. The gas ionization apparatus of claim 11 wherein the ionizing electrode comprises a tapered pin with a sharp point facing the shell orifice, the point producing a generally spherical plasma region comprising ions and byproducts when the ionizing electrical potential is applied to the pin; and the evacuation port comprises a conductive hollow socket within which the tapered pin is seated such that the ionizing electrical potential may be applied to the pin through the evacuation port.

14. The gas ionization apparatus of claim 11 wherein the through-channel is at least partially formed of a conductive material and comprises a means for superimposing an electric field in response to application of a non-ionizing electrical potential.

15. The gas ionization apparatus of claim 13 wherein the ionizing electrical potential is a radio-frequency electrical potential at least equal to the corona threshold of the ionizing electrode whereby the plasma region is substantially electrically balanced and the byproducts are substantially neutralized.

16. The gas ionization apparatus of claim 11 wherein at least a substantial portion of the byproducts are gases evacuated through the evacuation port and selected from the group consisting of ozone and nitrogen oxides.

17. The gas ionization apparatus of claim 11 further comprising at least one eductor that is upstream from the shell, the eductor having a motive connection for receiving the non-ionized gas stream and an exhaust connection for passing the non-ionized gas stream downstream to the through-channel.

18. The gas ionization apparatus of claim 17 wherein the eductor is at least partially in gas communication with the through-channel and the exhaust connection of the eductor faces the shell orifice; and the apparatus further comprises a non-ionizing electrode for superimposing an electric field in response to application of a non-ionizing electrical potential, the electrode being positioned outside of the through-channel and upstream of the shell orifice.

19. The gas ionization apparatus of claim 17 wherein the eductor is at least partially in gas communication with the through-channel and the shell orifice faces the exhaust connection of the eductor.

20. The gas ionization apparatus of claim 17 wherein the ionizing electrical potential is a radio-frequency electrical potential at least equal to the corona threshold of the ionizing electrode whereby the ionizing electrode produces both positive and negative ions;

the eductor further comprises a suction connection in gas communication with the evacuation port to thereby present the gas pressure in the vicinity of the orifice that is less than the pressure of the non-ionized gas stream in the vicinity of the orifice; and the apparatus further comprises a byproduct trap in gas communication with the evacuation port and the suction connection of the eductor.

21. The gas ionization apparatus of claim 11 wherein the ionizing electrode comprises a tapered emitter pin with a sharp point that produces a generally spherical plasma region during corona discharge of ions, the point facing the shell orifice and being recessed from the shell orifice by a distance that is substantially equal to or greater than the diameter of the plasma region;

the shell orifice is generally circular and has a diameter; and the ratio of the shell orifice diameter and the recess distance is between about 0.5 and about 2.0.

22. The gas ionization apparatus of claim 11 wherein the through-channel further comprises a removable plug and the emitter shell assembly is installed in the through -channel via the removable plug.

23. The gas ionization apparatus of claim 11 wherein the ionizing electrode is made of a material selected from the group consisting of metallic conductors, non-metallic conductors, semiconductors, single-crystal silicon and polysilicon; and the evacuation port is connected to a source of low pressure and provides gas flow in the shell in the range of about 1-15 liters per minute to thereby evacuate at least a substantial portion of the byproducts.

24. The gas ionization apparatus of claim 11 wherein the ionizing electrode comprises at least one strand of wire; and the apparatus further comprises a second through-channel for receiving the non-ionized gas stream and for delivering the clean ionized gas stream to the target.

25. A method of converting a non-ionized gas stream flowing in a downstream direction into a clean ionized gas stream flowing in the downstream direction toward a charge neutralization target, comprising:

establishing a plasma region comprising ions and contaminant byproducts; and inducing at least a substantial portion of the ions to migrate from the plasma region into the non-ionized gas stream while preventing at least a substantial portion of the byproducts from migrating into the non-ionized gas stream to thereby produce the clean ionized gas stream flowing downstream toward the charge neutralization target.

26. The method of claim 25 wherein the step of inducing further comprises superimposing a non-ionizing electric field in the plasma region sufficient to induce a substantial portion of the ions to migrate into the non-ionized gas stream and insufficient to induce substantially any of the byproducts to migrate into the non-ionized gas stream.

27. The method of claim 25 wherein the step of inducing further comprises evacuating a substantial portion of the byproducts out of the plasma region and away from the non-ionized gas stream without evacuating a substantial portion of the ions away from the non-ionized gas stream.

28. The method of claim 27 wherein the step of inducing further comprises evacuating and trapping a substantial portion of the byproducts out of the plasma region without preventing a substantial portion of the ions from migrating into the non-ionized gas stream.

29. The method of claim 28 further comprising trapping the evacuated byproducts.

30. The method of claim 25 wherein the step of establishing further comprises establishing a protected plasma region within the non-ionized gas stream such that substantially no non-ionized gas flows in the downstream direction within the plasma region.

31. The method of claim 25 wherein the step of establishing further comprises establishing a radio-frequency, ionizing electric field in the plasma region to thereby entrain the contaminant byproducts in the plasma region.

32. The method of claim 25 wherein the step of establishing further comprises establishing a radio-frequency, ionizing electric field in the plasma region whereby the plasma region is substantially electrically balanced and the contaminant byproducts are substantially neutralized.

33. The method of claim 25 wherein the non-ionized gas is an electropositive gas and the step of establishing further comprises establishing a plasma region comprising electrons, positive and negative ions and byproducts.

34. A method of separating corona generated contaminant byproducts from corona generated ions, comprising:

establishing a non-ionized gas stream having a pressure and flowing in a downstream direction;

applying an ionizing electric field to thereby establish a plasma region comprising ions and contaminant byproducts, the plasma region having a pressure sufficiently lower than the pressure of the non-ionized gas stream in the vicinity of the plasma region to prevent at least a substantial portion of the contaminant byproducts from migrating into the non-ionized gas stream; and superimposing a non-ionizing electric field in the plasma region sufficient to induce at least a substantial portion of the ions to migrate into the non-ionized gas stream.

35. The method of claim 34 wherein the pressure at the plasma region is sufficiently lower than the pressure of the non-ionized gas stream in the vicinity of the plasma region to prevent substantially all of the contaminant byproducts from migrating into the non-ionized gas stream.

36. The method of claim 34 further comprising evacuating substantially all of the contaminant byproducts out of the plasma region and trapping substantially all of the evacuated contaminant byproducts.

37. The method of claim 34 wherein the step of applying an ionizing electric field further comprises applying a radio-frequency, ionizing electric field in the plasma region to thereby entrain the contaminant byproducts in the plasma region.

38. The method of claim 34 wherein the gas is an electropositive gas and the step of applying an ionizing electric field further comprises establishing a protected plasma region within the non-ionized gas stream such that substantially no non-ionized gas flows in the downstream direction within the plasma region, the plasma region comprising electrons, positive and negative ions and contaminant byproducts.

39. The method of claim 34 further comprising evacuating a substantial portion of the contaminant byproducts out of the plasma region and away from the non-ionized gas stream without evacuating a substantial portion of the ions away from the non-ionized gas stream.

40. The method of claim 39 further comprising trapping the evacuated contaminant byproducts.

41. The method of claim 34 wherein the non-ionized gas is an electropositive gas and the step of applying an ionizing electric field further comprises establishing a plasma region comprising electrons, positive and negative ions and contaminant byproducts.

42. A gas ionization apparatus for use with a non-ionized gas stream having a pressure, the apparatus producing a clean ionized gas stream that flows toward a charge neutralization target and the apparatus comprising:

a said charge neutralization target;

means for establishing a plasma region comprising ions and contaminant byproducts; and means for superimposing a non-ionizing electric field sufficient for inducing at least a substantial portion of the ions to migrate from the plasma region into the non-ionized gas stream while preventing at least a substantial portion of the contaminant byproducts from migrating into the non-ionized gas stream to thereby produce a clean ionized gas stream that flows toward the neutralization target.

* * * * *